US005299823A

United States Patent [19]

Glaser

[11] Patent Number: 5,299,823

[45] Date of Patent: Apr. 5, 1994

[54] SNOW BOARD BINDING AND METHOD

[76] Inventor: John Glaser, 13404 SE. 32nd St., Bellevue, Wash. 98005

[21] Appl. No.: 82,883

[22] Filed: Jun. 25, 1993

Related U.S. Application Data

[63] Continuation-in-part of Ser. No. 10,638, Jan. 28, 1993, abandoned.

[51] Int. Cl.[5] ..... A63C 9/20

[52] U.S. Cl. ..... 280/625; 280/607; 280/617; 280/14.2

[58] Field of Search ..... 280/601, 607, 617, 618, 280/624, 625, 14.2, 634

[56] References Cited

U.S. PATENT DOCUMENTS

| | | | |
|---|---|---|---|
| 3,258,274 | 6/1966 | Beecher | 280/627 |
| 3,716,248 | 2/1973 | Wiley | 280/627 |
| 3,943,882 | 3/1976 | Sollak et al. | 280/634 |
| 4,652,007 | 3/1987 | Dennis | 280/618 |
| 4,735,435 | 4/1988 | Hornschemeyer et al. | 280/634 X |
| 4,973,073 | 11/1990 | Raines et al. | 280/624 |
| 5,035,443 | 7/1991 | Kincheloe | 280/618 |
| 5,054,807 | 10/1991 | Fauvet | 280/14.2 X |

FOREIGN PATENT DOCUMENTS

| | | | |
|---|---|---|---|
| 397969 | 11/1990 | European Pat. Off. | 280/14.2 |
| 2647358 | 11/1990 | France | 280/14.2 |

*Primary Examiner*—Margaret A. Focarino
*Assistant Examiner*—Michael Mar
*Attorney, Agent, or Firm*—Hughes & Multer

[57] ABSTRACT

A snowboard binding assembly comprising a fixed jaw to engage one side of a boot, and a slide jaw assembly to engage an opposite of the boot. An operating lever positions a slide jaw housing in a locking mode where the slide jaw assembly is fixed in locking engagement with the boot, an intermediate step-in position where the slide jaw housing can move laterally to a release position, and a disengaging position where the slide jaw housing is either positively moved to the release position or can readily be moved to the release position in opposition to the spring. In one preferred embodiment, a locking finger is mounted to a rotatable shaft connected to the positioning lever, and a cam finger causing movement of the slide jaw housing is mounted to the cam member.

34 Claims, 22 Drawing Sheets

FIG. 40
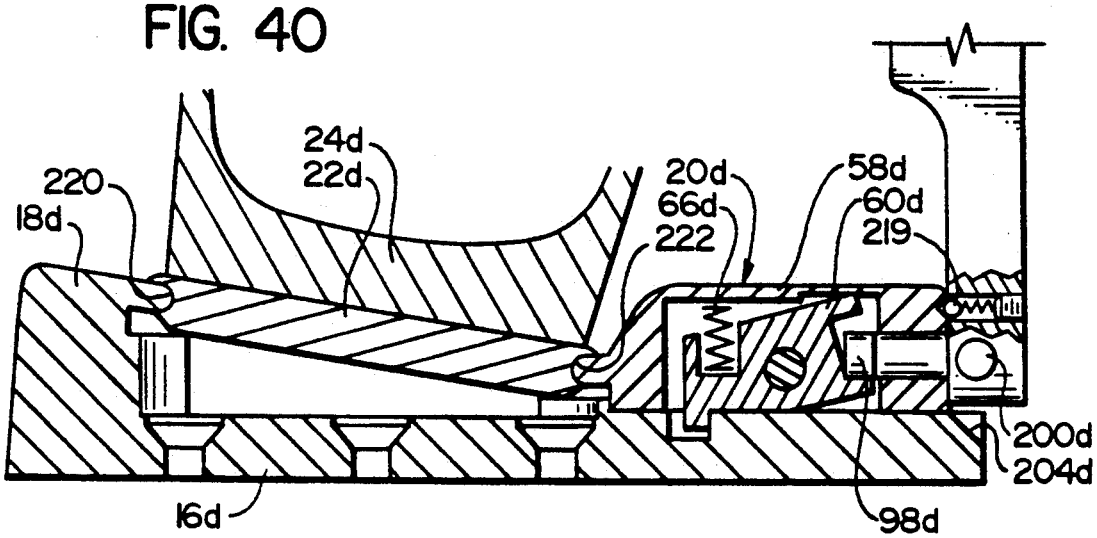
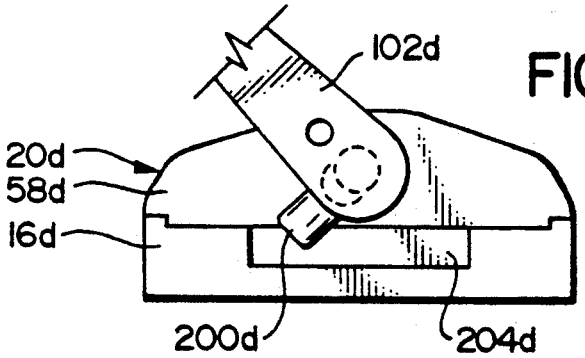
FIG. 42
FIG. 41
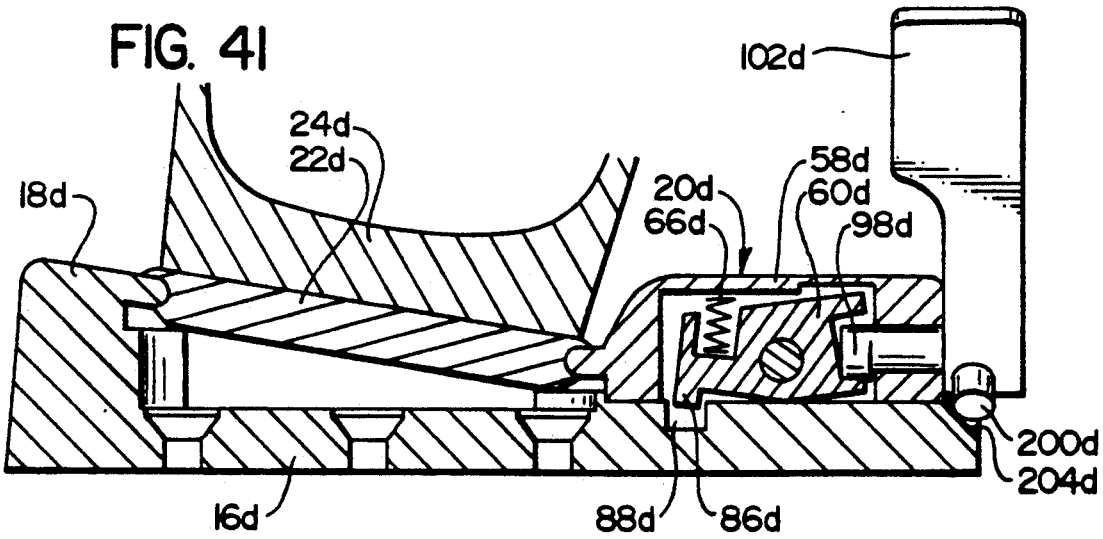

SNOW BOARD BINDING AND METHOD

CROSS REFERENCE TO RELATED APPLICATIONS

The present application is a continuation-in-part of U.S. patent application Ser. No. 08/010,638, entitled "SNOW BOARD BINDING AND METHOD, filed on Jan. 28, 1993, now abandoned naming JOHN GLASER as the inventor.

BACKGROUND OF THE INVENTION a. Field of the Invention

The present invention relates to a binding that secures a person's boot in place, and more particularly to such a binding which is particularly adapted for use in connection with snow boards.

B. Background Art

In recent years, the sport of snow boarding has become increasingly popular, and this activity often takes place on ski slopes. Accordingly, the snow boarder, after completing his run down the snow covered ski slope, then makes his way to the chairlift to be carried to the top of the slope of the next run.

The arrangement of the conventional chairlift is such that the skiers will get in line for the chairlift, and make their way forward in the line as people continue to be carried up by the lift. If the pathway to the boarding location of the chairlift has a moderate uphill slant, then the skier will often use his poles to assist him in moving further along the path.

However, for the snow boarder this presents a somewhat different set of problems. First, the person using a snow board generally does not carry ski poles or the equivalent thereof. Therefore, when the person using the snow board has to make his way up even a moderately inclined pathway to the boarding point of the chairlift, it would be necessary for the person to either take off the snow board and walk up to the boarding point of the chairlift, or to disengage at least one foot from the snow board and use the one foot to push his way up the path while the other foot remains on the snow board. Then when the person moves into place at the boarding position in the path of the moving chair, the person will usually immediately move the free foot into engagement with the binding on the snow board. Then the person simply sits on the chair as the chair moves into a position proximate to the person's legs, and the person is then carried up the hill in the chairlift.

When a person wearing skis is carried upwardly by the chairlift and approaches the unloading location, the person will normally simply stand up from the chair and ski away from the unloading location. On the other hand, if the person has a snow board with one foot disengaged, he will have to reconnect his disengaged boot to the snow board shortly before unloading. Then at the unloading location, the person with the snow board will be able to stand up from the chair and snow board down the incline from the unloading location. More often, the snow boarder will have both feet secured to the snow board when he first sits on the chair at the boarding location. Overall, the snow boarder faces a somewhat different set of problems in utilizing the conventional chairlift at a skiing facility.

Another consideration is that the releasing requirements are somewhat different for snow boarding than for snow skiing. When a person falls on snow skis, one of the snow skis may remain in a normal position aligned in a forward to rear direction, while the other ski may catch and begin turning in a manner to begin twisting the person's foot. Accordingly, the ski binding must release at a predetermined force level that is below that force level which (if exerted in a twisting or other motion on a person's foot) would damage the person's foot, ankle or leg.

On the other hand, since the snow board itself is a single object to which the snow boarder's feet are secured, it is customary to hold the snow boarder's feet to the snow board more securely, the reason being that it would be rather uncommon for a single foot to be subjected to the sort of twisting motion that could occur in snow skiing. However, since the snow boarder must be able to engage or disengage his feet with the snow board, there must be an adequate release mechanism which is convenient to operate. This is particularly true under the circumstances where the snow boarder is using a conventional chairlift, and is (as described above) disengaging and engaging at least one foot with the snow board in getting on to the chair and unloading from the chair.

Another consideration is that sometimes the person with the snow board will take a fall on the slope and end up in a precarious position in deep snow, and this situation could even be life threatening. Then, it becomes necessary for the snow boarder to disengage his boots from the snow board so that he could recover from that position in the deep snow. Accordingly, the disconnecting mechanism in the snow board binding must be such as to provide a quick and convenient release.

A search of the patent literature has disclosed a number of patents relating to snow board bindings particularly (and to some extent snow ski bindings), and these are presented below.

U.S. Pat. No. 5,035,443 (Kincheloe) shows a ski board binding where there is what is called a socket portion 26 that is attached to the board, and an attachment plate which attaches to the boot and slides into engagement with the socket member 26. (See FIG. 1 and FIG. 3.) To hold the boot in place, the plate 28 that is attached to the boot engages a retaining member 80. As can be seen in FIGS. 5 through 8, the plate 28 is slid laterally into the slideways defined by the retaining members 38 and 40, and as can be seen in FIG. 7, as the plate 28 slides in, it will depress the retaining member 80. When the plate 28 is fully in place, the retaining member 80 springs back up to lock the plate (to which the boot is attached) to the ski board. To release the retaining member there is a tab member 92 provided that is depressed to in turn depress the retaining member 80.

U.S. Pat. No. 4,973,073 (Raines et al) shows a snow board binding where there is a stationary retaining member 60 that is fixedly attached to the ski board and engages one side of a plate attached to the boot. Then there is a second oppositely positioned boot engaging member 70 that has a base portion 74 and a hooking lip 76 which is spring loaded to move toward the boot and engage an opposite side of the plate that is attached to the boot. This hook member 76 is spring loaded to its retaining position, and there is a release member 102 that can be manually grasped to release the boot from the binding.

U.S. Pat. No. 4,652,007 (Dennis) shows a snow board binding where there is a toe piece binding clip assembly 15 mounted to the ski board and a heel engaging safety release clip assembly 16 also attached to the ski board. These are conventional safety binding elements, and it is indicated in the text of the application that these could be of the type manufactured by Salomon (Model S-626). The boot is attached to a member that has what might be called an X shape in that the forwardly and rearwardly extending elements engage the forward and rear binding assemblies 15 and 16, and the laterally slanting portion supports the toe and heel portion of the boot.

U.S. Pat. No. 3,716,248 (Wiley) shows a ski boot binding for a snow ski where there is a toe retaining element and a heel retaining element. There is a spring loaded member 147 that moves in a path parallel to the ski as it moves from its latching to its unlatching position.

U.S. Pat. No. 3,258,274 (Beecher) shows a clipping element in a ski binding that slides along the axis of the ski.

SUMMARY OF THE INVENTION

The binding assembly of the present invention is adapted to hold a person's boot in an operating location on a snowboard or the like and to permit release of the boot. The binding assembly has a retaining position and a release position. Also, this assembly has three operating modes, namely:

a. a first locking mode where the boot is fixedly held in the operating position;
b. a second intermediate mode where movement of the assembly from the retaining position to the release position is yieldingly resisted in a manner to permit movement of said boot into the operating location of the binding assembly and into retaining engagement therewith;
c. a third release operating mode where the assembly is either at, or easily movable to, the release position to permit easy removal of the boot from the operating location.

The boot assembly comprises a base mounting means. There is a jaw means mounted in the base mounting assembly so as to be movable from a boot retaining position engaging the boot at the operating location to a boot release position spaced from the boot retaining position.

There is a locking means having a locking position where it is an operatively locking engagement between the jaw member and the base mounting means to prevent movement of the jaw member from the boot retaining position to said boot release position and a lock release position where the locking means is out of operative locking engagement. Spring means urges the jaw member toward the retaining position.

There is selectively operable positioning and control means which is movable between first, second and third control mode positions to place the assembly in the first, second and third operating modes, as follows:

a. in the first control mode position to locate the locking means in the locking engagement to prevent movement of the jaw member from the boot retaining position;
b. in the second control mode position to place the locking means in the lock release position and to permit said spring means to urge said jaw means to the boot retaining position;
c. in the third control mode position to either move the jaw means to the boot release position or to at least partly limit effect of said spring means so that said jaw means can with less resisting force from the spring means move to the boot release position.

In a preferred form, the binding assembly is arranged with surface entry means to guide a boot plate means of the boot into the operating location of the assembly.

Also in the preferred form, the locking means comprises a locking finger means moveably mounted to one of the jaw means and the base mounting means so as to be movable into abutting locking relationship with the other of the jaw means and the base mounting means. Specifically, the locking finger means is movable into a recess of the other of the jaw means and the base mounting means. Also in a preferred embodiment, there is a rotatable shaft with the finger means mounted to, and rotatable with the shaft.

Also, in a preferred form, the positioning and control means comprises a cam member mounted to one of the jaw means and the base mounting means. The other of the jaw means and the base mounting means has a cam surface, and the cam member is movable to engage the cam surface in a manner to cause the jaw means to move from the boot retaining position to the boot release position. In a preferred form, the cam means is mounted to the shaft means.

Also, desirably, the jaw means comprises a jaw housing mounted for substantially horizontal linear motion between the boot retaining position and the boot release position.

In one arrangement, the locking finger means and the cam member are positioned within the jaw housing. In another arrangement, the cam member is positioned outside the jaw housing.

In one embodiment, there is a locking arm means moveably mounted to one of the jaws means and the base mounting means and having the locking finger. Also, there is locking arm spring means which releasably urges the locking arm means toward locking engagement. Specifically, the locking arm means has a lengthwise axis and is pivotally mounted for rotation about an axis of rotation transverse to the lengthwise axis. A positioning spring yieldingly urges the locking arm toward its locking position.

In the preferred form, there is a manually operably control handle movable between three operating positions, namely a first position to place the assembly in the locking mode, a second position to place the assembly in the intermediate mode, and a third position to place the assembly in the release mode.

Another feature of the present invention is that the base mounting means comprises a base plate adapted to be fixedly connected to the snowboard, and a mounting plate adjustably mounted to the base plate for movement to different angular positions. One of the base plate and the mounting plate have retaining screws mounted in arcuate slots for rotational adjustments. In one version, the screws are mounted in the mounting plate and extend downwardly therefrom with the slots being formed in the base plates. The assembly further comprises retaining nut means mounted in the base plate to engage the screws, whereby the screws can be tightened or loosened from a position above the base plate.

Another feature is that in one embodiment the mounting plate is positioned to extend transversely to the lengthwise axis of the person's boot, and the mounting plate comprises forward and rear support extensions to engage the fore-foot and heel portions of the person's foot.

Other features of the present invention will become apparent from the following detailed description.

BRIEF DESCRIPTION OF THE DRAWINGS

FIG. 40 is a view similar to FIG. 39, but with the boot plate fully retained in the binding, with the binding still in its intermediate mode;

FIG. 41 is a sectional view, similar to FIGS. 38, 40 and 42 where the lever is being moved part way from the position of the intermediate mode to the position of the disengaging mode, and where the cam finger is engaging a cam surface to begin movement of the slide jaw housing toward the release position;

FIG. 42 is an end view similar to FIG. 38, with the lever being positioned at a location between its positions at the intermediate mode and the disengaging mode, as in FIG. 41;

FIGS. 49 through 52A are four figures taken in section along the longitudinal axis of the control shaft showing the sequence of moving the binding from the locking mode (FIG. 49A) to the intermediate mode (FIG. 50B), part way between the intermediate mode and the release mode (FIG. 51A), and finally to the release mode (FIG. 52A);

FIGS. 49B through 52B are four figures corresponding to FIGS. 49A through 52A, respectively, along a sectional view taken at line 49B—49B of FIG. 49A, showing the binding in the four modes, corresponding to the related figures of 49A through 52A;

FIGS. 49C through 52C are sectional views similar to FIGS. 49B through 52B, showing the sequence of moving from the locking mode to the full release mode but with the handle positioned 180° opposite to the positioning of the handle in FIGS. 49B through 52B so that instead of moving the handle clockwise in the sequence of FIGS. 40B through 52B, the handle is moved in a counterclockwise fashion,. as in FIGS. 49C through 52C, this arrangement enabling the identical binding to be used for both right and left foot bindings, but with the position of the handle reversed;

DESCRIPTION OF THE PREFERRED EMBODIMENTS

Figure 1:
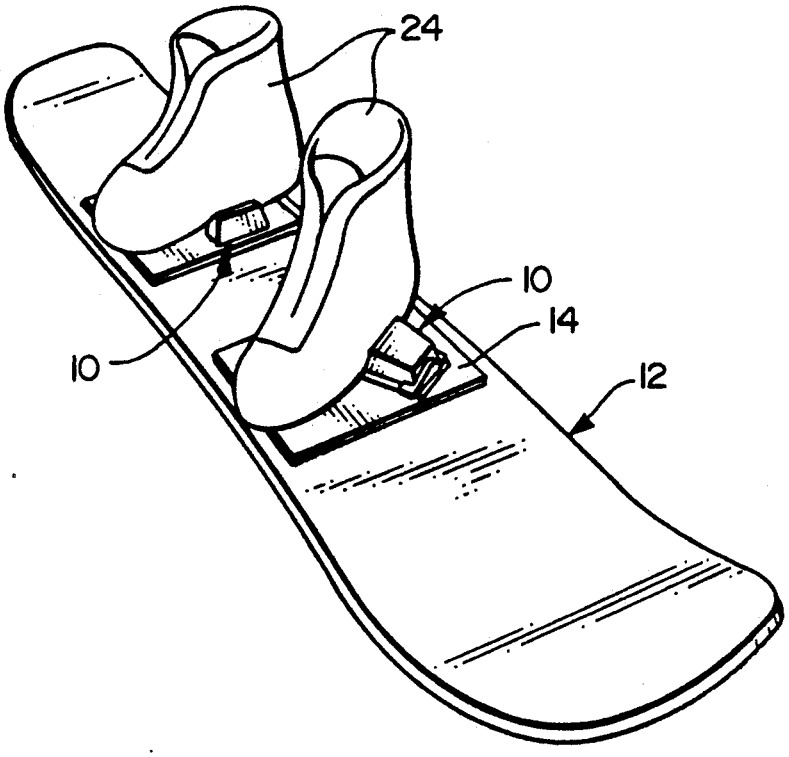
FIG. 1 is an isometric view illustrating a first embodiment of the present invention mounted to a snow board.
Figure 2:
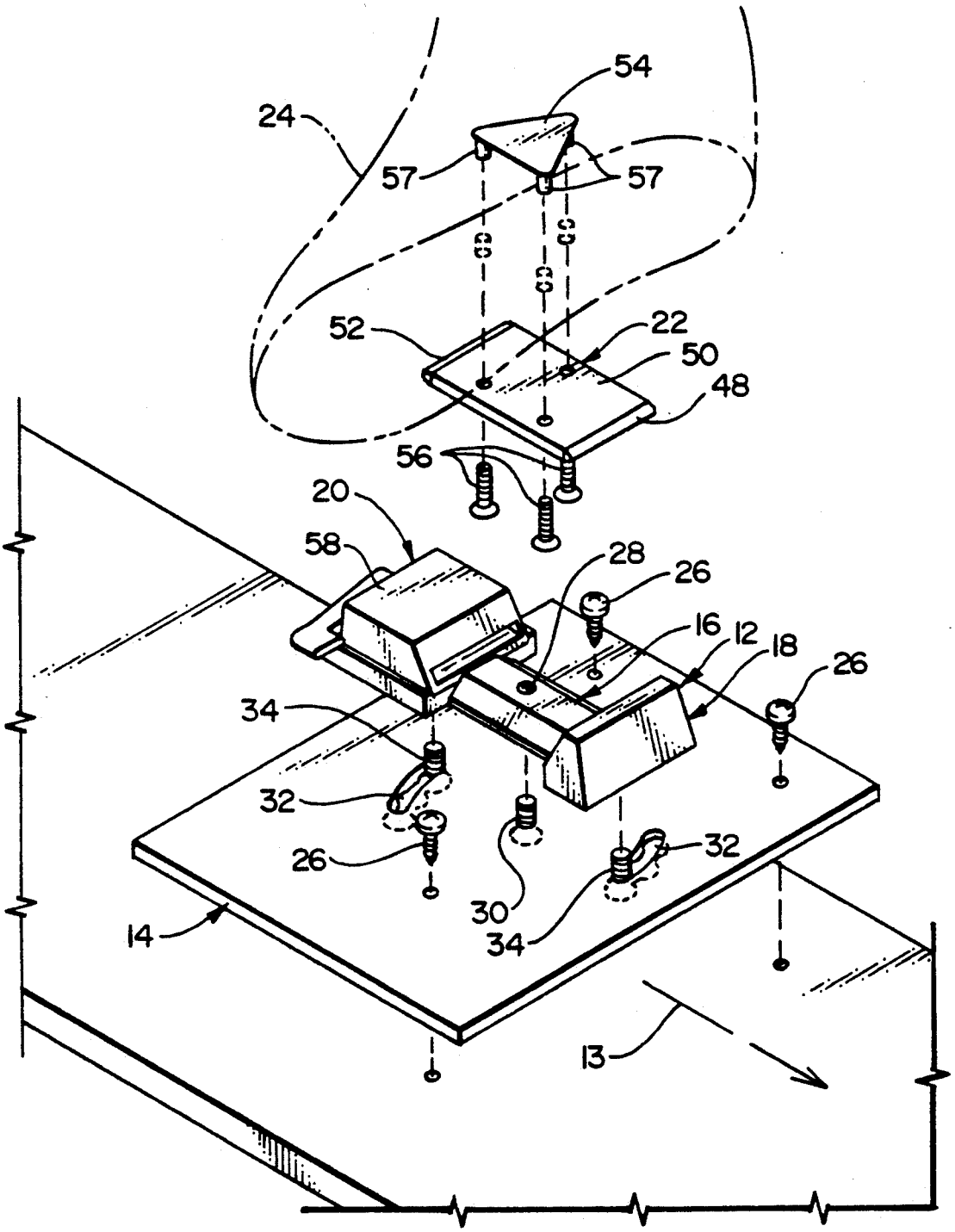
FIG. 2 is an isometric exploded view of the binding of the first embodiment, with the components being shown separated from one another.

A first embodiment of the present invention is illustrated in FIGS. 1 through 14. There are shown a forward and rear snow board bindings 10 mounted at forward and rear locations, respectively, to a snow board 12. Since the forward and rear bindings 10 have the same (or at least substantially similar) construction, for ease of explanation, only the rear binding 10 will be described in detail.

In the following description, the term "forward" or "front" denotes proximity to (or orientation toward) the forward end of the board 12 to which the binding is mounted, and the terms "rearward" or "rear" will denote the opposite direction. The longitudinal axis, shown at 13 in FIG. 2, extends in a forward to rear direction.

Each binding 10 comprises five main components. There is first the base plate 14 is fixedly secured to the upper surface of the board 12. A mounting plate 16 is adjustably mounted to the base plate 14 so that it can be positioned at various angular positions relative to the longitudinal axis of the board 12. On one side of the mounting plate 16, there is a fixed jaw 18 that is made integral with, or fixedly connected to, the mounting plate 16. On the opposite side of the mounting plate 16 is a releasable or slide jaw assembly 20. Then there is a boot plate 22 which is mounted to the sole of the person's boot 24, and is arranged to be engaged by the fixed jaw 18 and the slide jaw assembly 20.

The base plate 14 is mounted to the upper surface of the board 12 by a plurality of screws 26. To connect the mounting plate 16 to the base plate 14, the base plate 14 is provided with a center screw hole 28 to receive a center mounting screw 30, and two arcuate slots 32 to receive a pair of other screws 34. In this first embodiment, the arcuate slots 34 each have (see FIGS. 2 and 14) three countersunk recesses 36 on the bottom side of the slots 32 to interfit with the head 38 of the outside screws 34. The screws 30 and 34 extend into threaded recesses 40 in the mounting plate 16 to hold the plate 16 to the base plate 14.

The aforementioned fixed jaw 18 is positioned at (and fixedly connected to) one side of the mounting plate 16. This jaw 18 has a downwardly and inwardly slanting inside surface 42 that terminates adjacent to the top surface 44 of the mounting plate 16. Near the bottom part of the surface 42, the jaw 18 is provided with an elongate retaining recess 46 that receives one edge portion 48 of the aforementioned boot plate 22.

The boot plate 22 has a generally rectangular planar configuration, with a main central plate portion 50 and two lateral edges, namely aforementioned edge portion 48 and the opposite edge portion 52. To connect the boot plate 22 to the boot 24, there is provided a connecting plate 54 that is mounted in the sole of the boot 24 or possibly above the sole of the boot 24. (See FIG. 2.) Several retaining screws 56 extend through the boot plate 22 into the sole of the boot 24 and connect to interiorly threaded stubs 57 attached to the plate 54. Obviously other means of connecting the boot plate 22 to the boot 24 could be utilized.

The main components of the slide jaw assembly 20 are a slide housing 58, a locking arm 60 mounted within the slide housing 58, a release a control member 62 mounted in the housing 58 in a manner to position the locking arm 60, two positioning springs 64, an intermediate arm positioning spring 66, and a pair of locating studs or bolts 68.

In general, these slide jaw assembly components 58 through 68 perform the primary function of engaging the edge portion 52 of the boot plate 22 so as to cooperate with the fixed jaw 18 to hold the boot plate 22 in its retained position. This is done in a manner so that the slide jaw assembly 20 has three operating modes. First, there is the disengaging or release mode (shown in FIGS. 4 and 5) where the locking arm 60 is in its disengaging position to permit the slide housing 58 to move more easily toward its release position (i.e. out of engagement with the boot plate edge 52). Second, there is the intermediate or step-in mode (shown in FIGS. 6 through 10) where the locking arm 60 engages the mounting plate 16 in an intermediate position where the slide housing 58 can again be moved to its release position, but with a relatively greater releasing force. This can also be called the "step-in position." Third, there is the lock position (see FIGS. 11 and 12) where the locking arm 60 is securely held in its locking position so that the slide housing 58 is totally prohibited from moving toward its release position.

To describe these components 58 through 68 more particularly, the slide housing 58 has a generally rectangular planar configuration, and the inside portion 70 of the housing 58 has an inwardly and downwardly facing slanting surface 72 generally matching the slanting surface 42 of the fixed jaw 18, with these two surfaces 42 and 72 serving the function of guiding the boot plate 22 into the retaining area between the fixed jaw 18 and the jaw assembly 20. This housing portion 70 has an inwardly facing lateral recess 74 matching the recess 46 in position to receive the edge 52 of the boot plate 22 securely in place when the slide housing 58 is positioned inwardly in its retaining position.

In further describing the binding 10, the mounting plate 16 will be considered as having a lengthwise axis 76 (See FIG. 3) extending along the center line of the mounting plate 76 from the fixed jaw 18 to the jaw assembly 20. The term "inside", in describing the slide jaw assembly 20, shall denote proximity to the boot retaining area 78, while the term "outside" shall denote proximity to the outside edge portion 80 of the jaw housing 58.

The slide housing 58 has a downwardly open center recess 82 that extends lengthwise and receives the locking arm 60. More particularly, there is a mounting pin 84 extending transversely in the housing 58 at approximately a center location of the recess 82, and this pin 84 extends through the middle portion of the locking arm 60 so that the arm 60 is pivotally mounted about the pin 84. At the inside end of the locking arm 60, there is a downwardly extending locking finger 86 that is positioned to fit within a locking recess 88 formed at the upper surface of the mounting plate 16. The aforementioned intermediate release spring 66 is positioned in a recess 90 formed in the upper forward part of the locking arm 60 and extends upwardly to bear against a downwardly facing surface in upper middle plate portion 94 that defines the upper part of the recess 82. This compression spring 66 urges the forward end of the locking arm 60 downwardly so that the locking finger 86 is urged to a position within the locking recess 88.

The rear end of the locking arm 60 is formed with a rearwardly facing slot 96 that receives a positioning cam 98 of the release control member 62. The cam 98 is in turn connected to an outwardly extending shaft 100 that extends through (and is rotatably mounted in) the rear wall of the housing 58 about an axis of rotation parallel to the lengthwise axis 76 of the mounting plate 16. This shaft 100 in turn connects to a positioning handle or lever 102 that is located exteriorly of the slide housing 58 and extends radially outwardly from the axis of rotation of the shaft 100. The handle or lever 102, the shaft 100, and the positioning cam 98 collectively comprise the release control member 62.

The slide housing 58 has two spring recesses 104 that are positioned on opposite sides of the lengthwise axis 76 of the mounting plate 76 in a direction parallel to this lengthwise axis 16. The two positioning springs 64 are positioned in these recesses 104. The outer end of each spring 64 bears against an outwardly positioned stub or pin 106 that extends into each recess 104 and is fixedly attached to the mounting plate 16. Thus, the two springs 64 act in unison to push from their related stubs 106 against a surface portion 108 of the housing 58 to urge this housing 58 inwardly toward its retaining position.

To provide a slide mounting for the housing 58, there is provided the aforementioned retaining bolts 68 (see FIGS. 3 and 9) extending upwardly so as to be threaded into matching threaded sockets 112 formed in the housing 58 on opposite sides of the lengthwise axis 76. The shank 114 of each bolt 68 extends downwardly through a related retaining slot 116, and the head 118 at the bottom end of the retaining bolt 68 is positioned in a moderately expanded recess 120 that is immediately below the slot 116. Thus, each slot 116 and its recess 120 collectively define a shoulder 122 extending entirely around the periphery of the slot 116, with this shoulder 122 retaining the bolt head 118 in the slot 116. Thus the two bolts 112 hold the slide housing 58 against the mounting plate 16, and permit limited slide motion in a direction parallel to the lengthwise axis 76.

There will now be a description of the operation of the slide jaw assembly 20, after which there will be a description of the overall operation of the binding 10.

Figure 4:
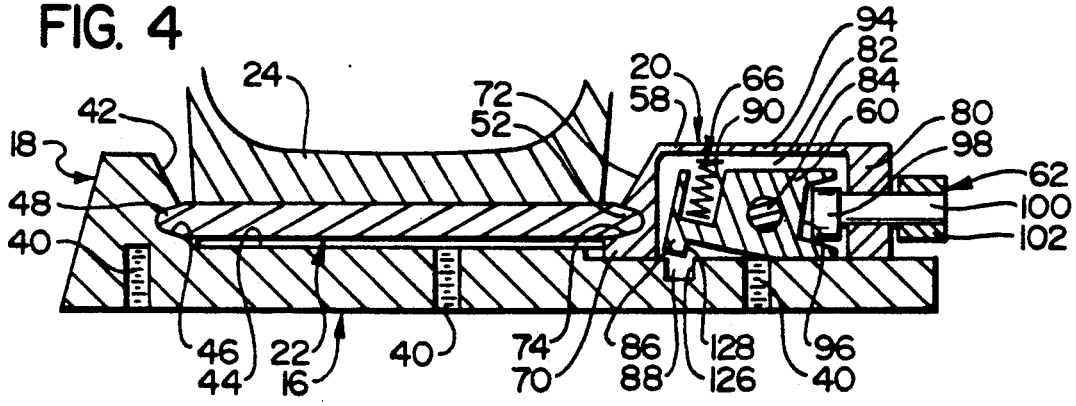
FIG. 4 is a longitudinal sectional view taken along line 4—4 of FIG. 3, showing the binding in its disengaging mode relative to the bootplate that is in turn attached to a person's boot.
Figure 5:
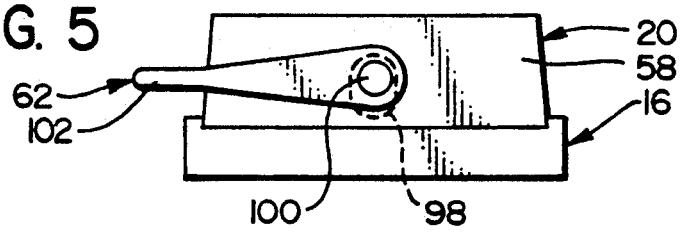
FIG. 5 is an end view of the binding as shown in FIG. 4, showing the control lever in its horizontal disengaging position.
Figure 10:
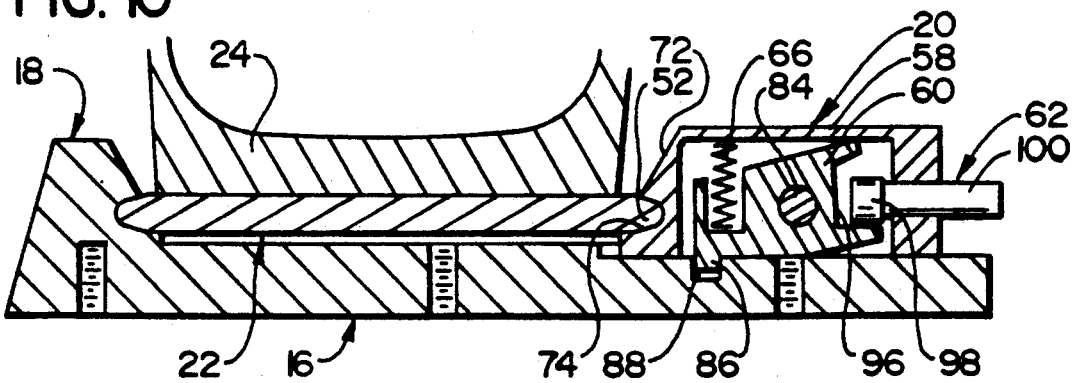
FIG. 10 is a sectional view similar to FIGS. 6 and 8, still showing the slide jaw assembly in its intermediate mode, but having been slid back to its retaining position.

With reference to FIGS. 4 and 5, the handle or lever 102 of the control member 62 is positioned in a first disengaging horizontally extending position that is transverse to the lengthwise axis 76. In this position of the member 62, the protruding portion of the positioning cam 98 is extending downwardly in the recess 96, so that the forward end of the locking arm 60 is held upwardly, and the locking finger 86 of the arm 60 is raised out of the locking recess 88. In this position of the control lever 62, the two positioning springs 64 push from the stubs 106 to urge the slide housing 58 to its inside retaining position as shown in FIG. 10. These two positioning springs 64 are of only moderate strength, and thus do not provide a substantial amount of resistance to the lateral outward motion of the slide housing 58. Thus, with the control lever 102 in its easy release position of FIG. 4 and FIG. 5, relatively less force is required to move the slide jaw housing 58 outwardly to its release position.

Figure 6:
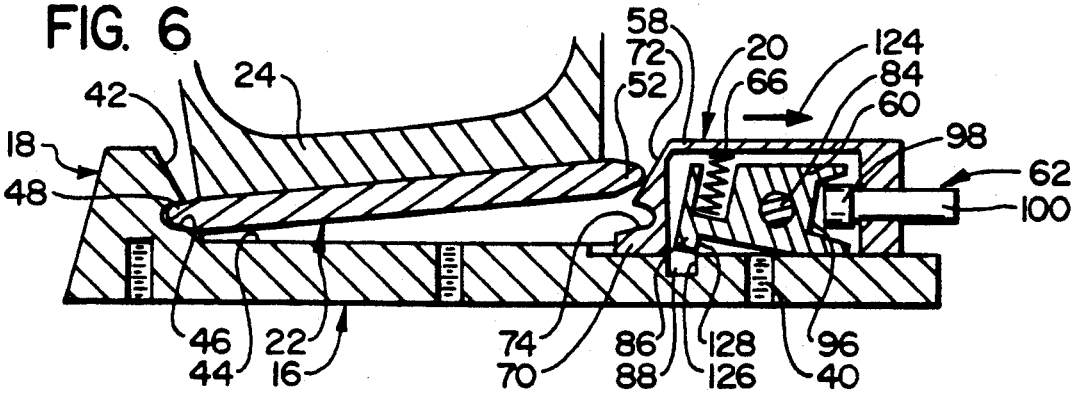
FIG. 6 is a sectional view similar to FIG. 4, showing the binding in its intermediate mode (or step-in mode) position where it is possible for the person to step into the binding with the binding then engaging the boot, showing the slide jaw assembly shifting to the right.
Figure 7:
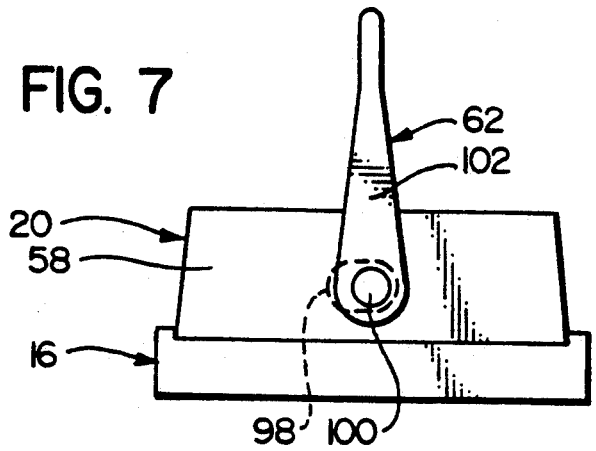
FIG. 7 is an end view similar to FIG. 5, showing the control lever in its intermediate position.
Figure 8:
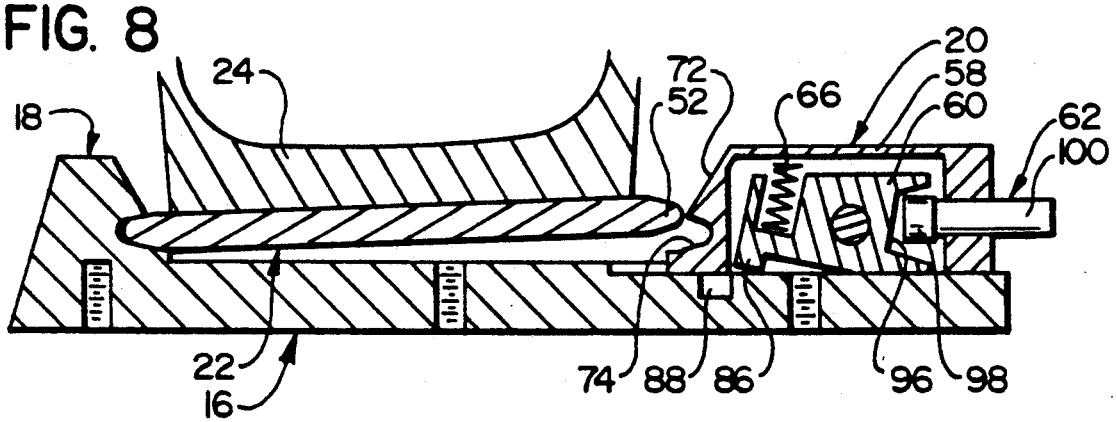
FIG. 8 is a sectional view similar to FIG. 6, where the binding is in its intermediate mode, but with the slide jaw assembly being shifted further to the right to its full release position as the person is stepping into the binding.
Figure 9:
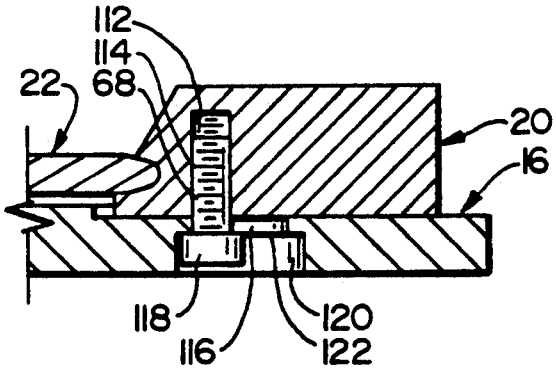
FIG. 9 is a sectional view taken along line 9—9 of FIG. 4, showing one of the slide mounting bolts for the slide jaw housing, with the slide jaw assembly in the position of FIG. 4.

In FIGS. 6 through 10, the slide jaw assembly 20 is shown in its intermediate position. As shown in FIG. 7, the positioning handle of the control lever 102 is, in the intermediate position, extending upwardly. Also, as can be seen in FIG. 6, the shaft 100 and the positioning cam 98 have been rotated through 90 degrees so that the positioning cam 98 extends laterally. With the cam 98 in this intermediate laterally extending position, the forward end of the locking arm 60 is able to rotate a short increment of accurate travel from the position of FIG. 6 (where the forward end of the locking arm 60 is positioned in its down position, upwardly to the position shown in FIGS. 8 and 10. However, it can be seen that the arm positioning spring 66 urges the forward end of the locking arm 60 downwardly toward its retaining position shown in FIG. 6.

With the slide jaw assembly 20 in the position of FIG. 10, it can be seen that the locking finger 86 is positioned within the locking recess 88 and is urged to remain in that position by the action of the intermediate release spring 66. In the position of FIG. 10, when an outward force is exerted against the housing 58 so as to move the housing 58 outwardly as indicated by the arrow 124 of FIG. 6 (i.e. by the person stepping into the binding so that the boot plate edge 52 engages the sloping surface 72 of the slide jaw housing 58). This outward movement is of course resisted by the two positioning springs 64.

In addition, the locking finger 86 being positioned in the locking recess 88 also resists this outward motion of the slide housing 58. However, it will be noted that the center axis of rotation of the locking arm 60, which is at the center of the mounting pin 84, is positioned outwardly and upwardly of the location of the locking recess 88. Thus, when an outward force is exerted on the housing 58, as indicated by the arrow 124 with reference to FIG. 6, it can be seen that the inwardly facing surface portion 126 of the recess 88 engaging the outwardly facing surface portion 128 of the locking finger 86 causes a rotational force to be exerted on the locking arm 60, with the center of rotation being about the center of the mounting pin 84. The effect of this is to rotate the forward portion of the locking arm 60 upwardly so that the locking finger 86 moves out of engagement with the recess 88. It can also be seen that this upward rotation of the forward portion of the locking arm 60 is resisted first by the intermediate release spring 66, and secondly by the frictional force between the two surfaces 126 and 128 of the recess 88 and the locking finger 86, respectively.

Thus, the resistance provided by the two positioning springs 64, and also the resistance provided by the upward rotation of the forward end of the locking arm 60 are additive to provide a resisting force to the outward movement of the housing 58 substantially greater than the resisting force provided by the two positioning springs 64 acting alone (as in the disengaging or release position shown in FIGS. 4 and 5). When the boot plate has moved fully into the binding 10, the slide jaw housing 58 will have moved to its full outward position of FIG. 8 and will promptly snap back to the position of FIG. 10 to engage the boot plate 22.

Figure 11:
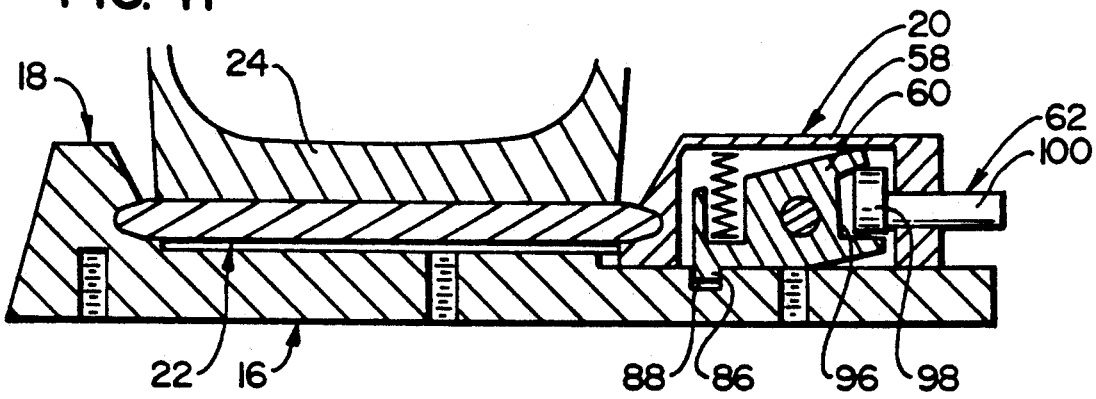
FIG. 11 is a sectional view similar to FIG. 4, but showing the binding in its locking mode.
Figure 12:
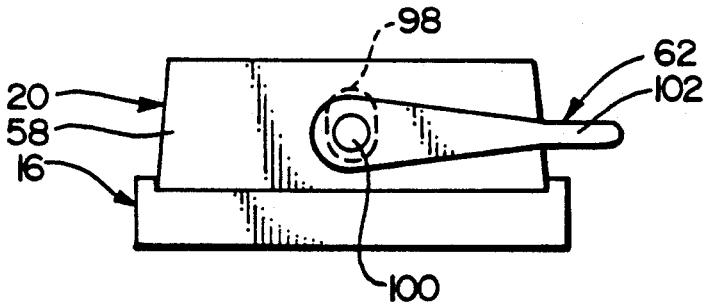
FIG. 12 is an end view similar to FIGS. 5 and 7, showing the control lever having been moved to the lock position.
Figure 13:
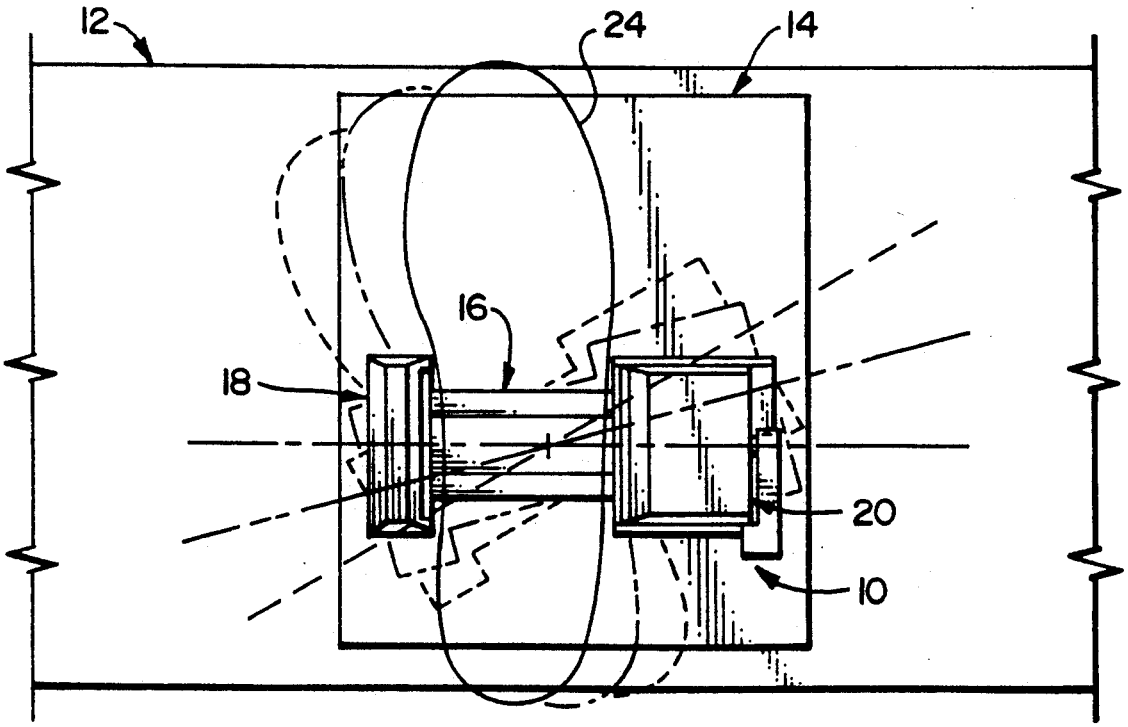
FIG. 13 is a top plan view of the binding of the first embodiment showing the mounting plate in different positions for placement of the person's boot at different angles, relative to the longitudinal axis of the snow board.
Figure 14:
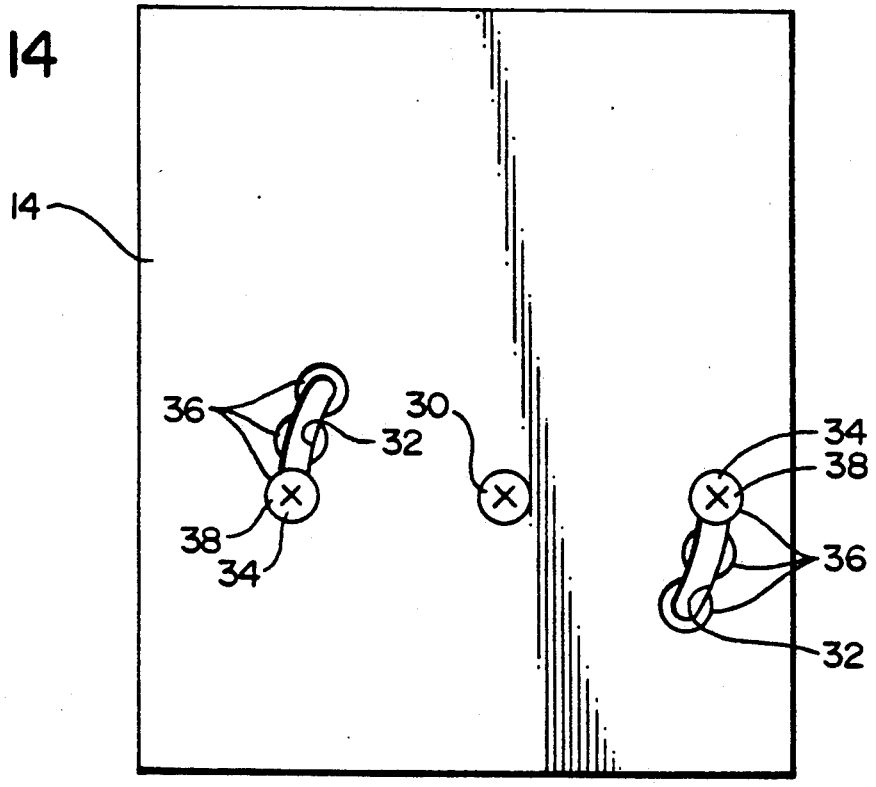
FIG. 14 is a bottom plan view of the base plate of the first embodiment, showing the mounting screws in one of three selected positions.
Figure 15:
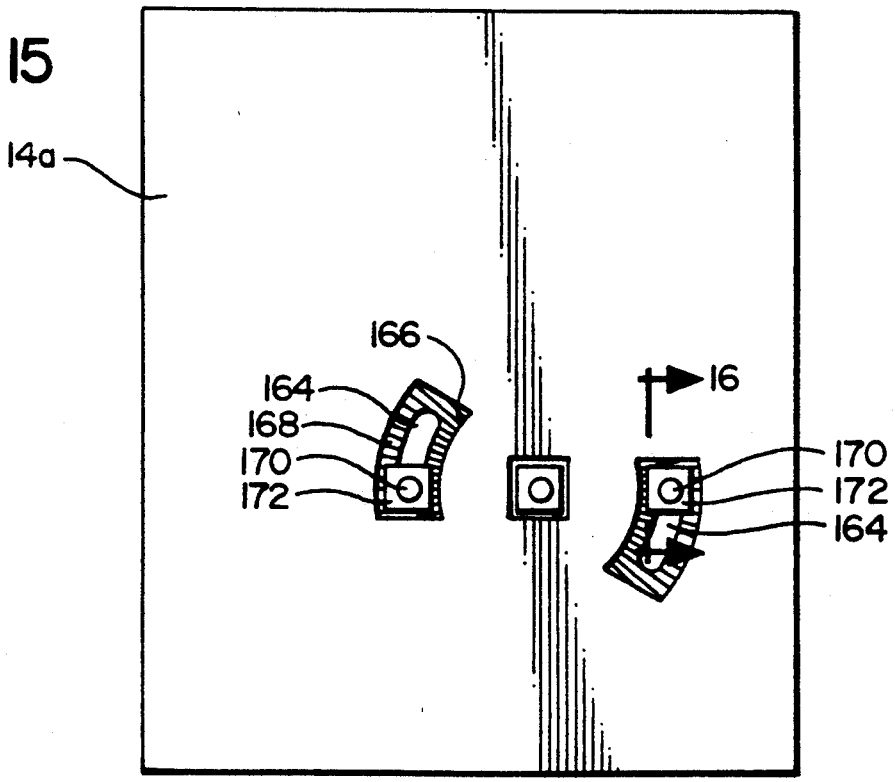
FIG. 15 is a bottom plan view of the base plate of a second embodiment of the present invention, where the retaining screws for the mounting plate can be placed in a greater variety of angular positions.

The third operating position of the slide jaw assembly 20 is illustrated in FIGS. 11 and 12. In this position, it can be seen that the lever 102 of the control member 62 has been rotated yet 90 degrees further from the upright position of the intermediate position shown in FIG. 7 to a horizontal position of FIGS. 11 and 12. As can be seen in FIG. 11, in this position of the control lever 62, the protruding portion of the positioning cam 98 is extending upwardly so as to hold the rear end of the locking arm 60 upwardly. The effect of this is to hold the forward locking finger 86 securely in the recess 88.

Thus, it can be appreciated that in the locking position of FIGS. 11 and 12, there is positive engagement between the control member 62 with the locking arm 60, and positive engagement of the locking finger 86 in the recess 88 of the mounting plate 16, so that there is overall positive locking engagement of the slide jaw housing 58 relative to the mounting plate 16.

Now to summarize briefly the three operating modes of the slide jaw assembly 20, there is the first disengaging mode of FIGS. 4 and 5, where only the two positioning springs 64 urge the slide jaw housing 58 inwardly to its retaining position. In this position, the housing 58 can be moved with relatively less force outwardly to the release position.

Second, there is the intermediate mode (or step-in mode) that is shown in FIGS. 6 through 10. In this position, the positioning springs 64 continue to urge the housing 58 inwardly toward the retaining position of FIG. 6. In addition, however, there is an action of the intermediate arm positioning spring 66 acting with the mounting arm 60 to provide another increment of resistance to the outward movement of the slide jaw housing 58. However, such outward movement of the slide jaw housing is possible, but only with an exertion of a greater outward force.

Finally, there is the locking mode of FIGS. 11 and 12, where there is positive engagement of the locking finger 86 in the recess 88 of the mounting plate 16.

With the foregoing description of the basic operation of the slide jaw assembly 20 in mind, let us now review the overall operation of the two snow board bindings 10 mounted to the snow board 12. First, the two mounting plates 16 of the two bindings 10 are positioned at the desired angular positions, this being accomplished by selecting the appropriate positions of the retaining screws 34 in the base plates 14. (See FIGS. 13 and 14.) Each of the two boot plates 22 has previously been secured to the sole of its related boot 24.

With the bindings 10 having their respective control levers 62 in either the disengaging mode (as in FIGS. 4 and 5) or in the intermediate mode of FIG. 6, it is a relatively simple matter for the person to move each boot 24 into engagement with the related binding 12 simply by placing the boot 24 over the binding 10 and moving it down so that the two edge portions 48 and 52 of the plate 22 bear against the two mounting entry surfaces 42 and 72. Generally, the person will have the binding in the intermediate mode when stepping into the binding, so that after stepping into the binding, the boot will be held more securely. This downward force of the boot plate 22 pushes the slide housing 58 outwardly so that the boot plate 22 moves downwardly into its retaining position of FIG. 10. When the plate 22 is in the retaining position, this releases the slide jaw housing 58 so that it moves inwardly (urged by the two positioning springs 64) to its retaining position of FIG. 10, with the plate edge portion 52 fitting in the retaining slot 74.

Let it now be assumed that the person is at the top of the slope and has just moved his two boots 24 into engagement with the two bindings 10, and is ready to snow board down the hill. The person moves the two handles 102 more likely from the upright intermediate position through 90 degrees to the locked position of FIGS. 11 and 12. Now the two boots 24 are locked securely to the snow board 12 for the run down the slope. In the event that the person falls and wishes to have an easy release from the board 12, the person simply rotates the two handles 102 180 degrees to the disengaging position, twists the two boots with moderate force, and the disengagement is easily accomplished, as described above.

Now, let it be assumed that the person using the snow board 12 has glided down the slope and has approached the boarding area of the chairlift to be carried back up the hill. At this time, the person may take the snow board 12 off entirely and simply carry it up toward the boarding location of the chairlift. Alternatively, the person may simply disengage one of his (or her) boots 24 from one of the bindings 10 (with the other boot 24 still secured in its binding 10), and move toward the boarding location of the chairlift by having one foot engaged in the binding 10 and moving the snow board along with the other foot in a stepping motion.

When the person is immediately adjacent to the boarding location (with only one boot 24 in its binding 10 and the other boot 24 free of its binding 10), the person then moves into the boarding location to sit on the oncoming chair. The person will at that time have the control lever 62 of the binding 10 without its boot 24 in the intermediate "step-in" position (see FIGS. 6 through 10). In the intermediate position of the binding 10, the person can readily engage the boot 24 with the binding 10 by pushing his foot downwardly so as to push the slide jaw housing 58 outwardly so that the boot plate 22 moves into the retaining position and the jaw housing 58 snaps shut, as in FIG. 11. Then when the chair arrives at the boarding location, the person simply sits down on the oncoming chair, with the person's boots 24 being attached by both of the bindings 10.

With the binding 10 that has just been engaged by the person in its intermediate position, the binding 10 holds the boot reasonably securely in place. Thus, the person does not, after becoming seated on the chair, have to manipulate the lever 10 to a more secure position. When the person reaches the deboarding location, he simply stands up from the chair and slides down the slope at the deboarding location for the next downhill run. As described above, the person then secures the binding 10 in the lock position for the downhill run.

Another method of boarding the chairlift would be for the person to simply carry the snow board 12 to the boarding location. Then when the person is immediately adjacent to the boarding location, he can place one boot 24 into its binding 10. The person then moves directly into the boarding area into the path of the oncoming chair, and he moves the other boot 24 onto the other snow board binding 10 so that both boots 24 are engaged by the bindings 10. In this instance, both of the control levers 102 would be in the intermediate position. Once engaged, the two boots are held reasonably securely to the two bindings 10.

Then, when the chair reaches the deboarding location, the person dismounts from the chair and simply slides down the slope to the location where the downhill run begins. The person will then move the control handles 102 downwardly (as described above) to the locking location and begin the downhill run. Again, the person is relieved of the task of having to reach down and move the lever 102 while sitting on the chair of the lift, although this can be done if the person wishes to do so.

To further describe one of the benefits of the present invention, let it be assumed that the person is sliding downhill in heavy snow and takes a fall so that the person is positioned precariously in a possibly dangerous position in a deep snowdrift. For the person to get out of the snowdrift, it may be necessary for him to disengage himself totally from the snow board 12. In this instance, the person needs to position his hand or hands adjacent to the bindings 10 and move the lever handles 102 to the easy release position, so that the boot can be released from the binding by a twisting motion relatively easily.

A second embodiment of the present invention will now be described with reference to FIGS. 15 through 18. Components of the second embodiments which are similar to components of the first embodiment will be given like numerical designations, with an "a" suffix distinguishing those of the second embodiment.

In general, the second embodiment has the same basic operation as the first embodiment. However, there are two features of improved adjustability, and one of providing easier access for shifting the position of the mounting plate **16*a***.

As in the first embodiment, the binding **10*a* of the second embodiment comprises a base plate 14*a*, a mounting plate 16*a*, a fixed jaw member 18*a*, a slide jaw assembly 20*a*, and a boot plate 22*a* attached to a related boot 24*a*. Also, the slide assembly 20*a* has the main components of a slide housing 58*a*, namely a locking arm 60*a*, a control member 62*a* and an intermediate arm positioning release spring 66*a*. Also, although not shown herein, it is to be understood that the slide assembly 58*a* also comprises positioning springs (such as shown at 64 in the first embodiment), and locating bolts (such as shown at 68** in the first embodiment).

The slide jaw housing **58*a* differs from the housing 58 of the first embodiment, in that the inward end portion of the housing 58*a* has a vertically adjustable housing portion 140. This adjustable portion 140 is provided with the slanting entry surface 72*a* that engages the edge portion 52*a* of the boot plate 22*a*. This edge portion 140 has an outer lower vertical surface portion 142 which bears against a matching inwardly facing surface portion 144. These two surfaces 142 and 144 are desirably serrated or otherwise formed so that there is a frictional or interfitting relationship that resists vertical relative movement between the member 140 and the slide housing 58*a***.

Figure 17:
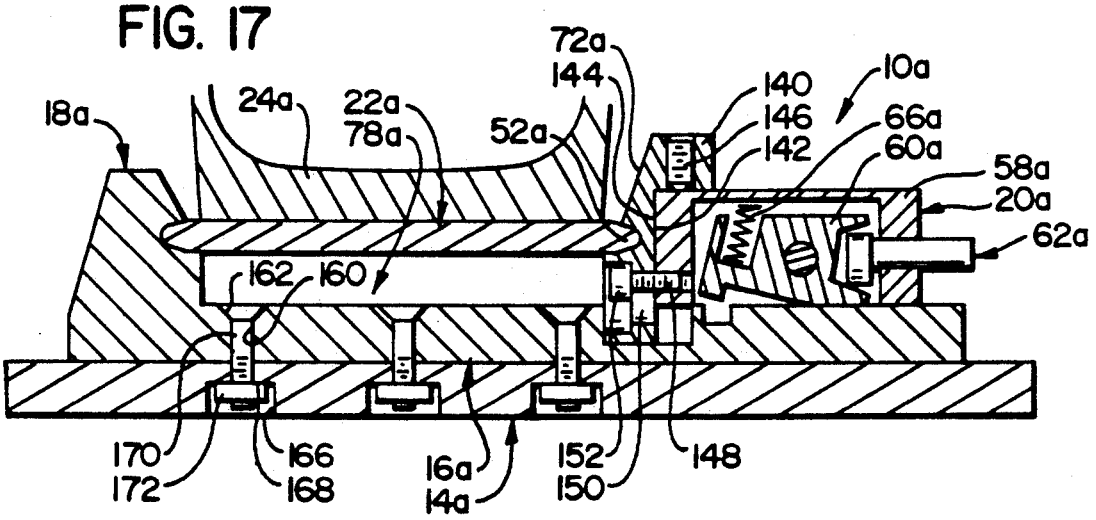
FIG. 17 is a sectional view similar to FIG. 4, showing the binding of the second embodiment.
Figure 18:
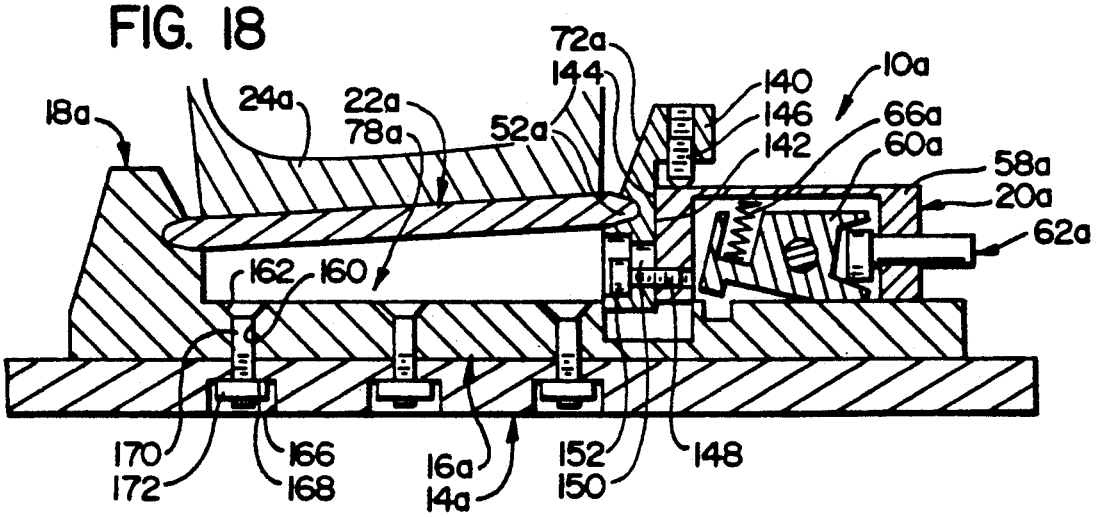
FIG. 18 is similar to FIG. 17, showing the adjusting block of the second embodiment moved to a higher position to place the boot plate at a more slanted position.
Figure 19:
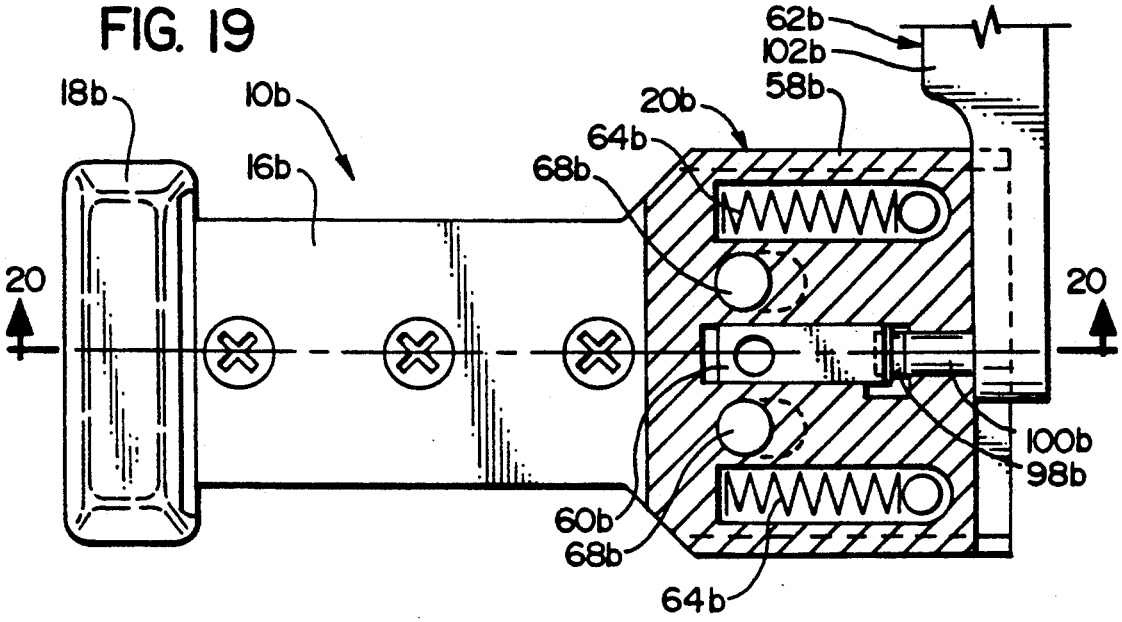
FIG. 19 is a plan view similar to FIG. 3, showing a third embodiment of the present invention in its lock position or mode.

To control the vertical position of the slide housing portion 140, there is provided at the upper part of the slide portion 140 a positioning screw 146 threaded into the housing portion 140. In FIG. 17, the positioning screw 146 is shown where it locates the member 140 in its lower position where the boot plate **22*a* is held horizontally relative to the mounting plate 16*a*. In FIG. 18, the positioning screw 146 is shown being screwed downwardly so as to lift the housing portion 140 upwardly so as to provide a slanted position for the boot plate 22*a***.

To hold the housing portion 140 in engagement with the slide jaw housing **58*a*, there is provided a retaining screw 148 that extends through a slot 150 in the member 140. The head 152 of the screw 148 bears against the surface 144 against the surface 142. It is apparent that by loosing the retaining screw 148, the housing portion 140 can be shifted vertically to adjust the angular position of the boot plate 22*a***.

Also, the manner in which the mounting plate **16*a* is attached to the base plate 14*a* differs in this second embodiment. It can be seen that the mounting plate has at the location of the retaining area 78*a* three through openings 160, each having an upper countersunk recess 162. The base plate 14*a* has three matching arcuate slots 164 having substantially the same width as the cylindrical opening 160. Beneath each slot 164, there is a somewhat wider arcuate recess 166 which forms with the slot 164 a perimeter lip or shoulder 168**.

Figure 16:
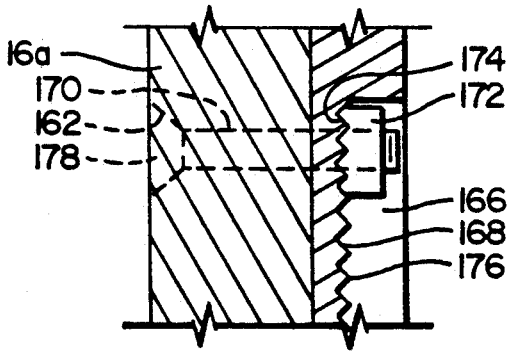
FIG. 16 is a sectional view taken along line 16—16 of FIG. 15, illustrating one of the mounting screws and its related nut in this second embodiment.

A retaining bolt 170 is inserted in each of the openings 160 so as to extend through the related slot 164 and into the related recess 166. A nut 172 is threaded onto the lower end of each bolt 170. As can be seen in FIG. 16, each nut 172 has an upper serrated surface 174 that comes into engagement with a matching serrated surface 176 on the perimeter shoulder 168. Also, each bolt 170 has a countersunk head 178 that fits into the countersunk hole portion 162.

With this arrangement, the angular position of the mounting plate 16a with respect to the base plate 14a can easily be adjusted as follows. The bolts 170 are rotated to cause the related nut 172 to move down the threaded portion of the bolt 170 in a manner that the serrated surface 174 of the nut 172 becomes disengaged from the matching serrated surface 176 of the base plate 14a. Then the mounting plate 16a can be rotated to the desired position, after which the bolts 170 are rotated to pull the related nut 172 into snug engagement with the base plate 14a so that the serrated surfaces 144 and 146 come into engagement with one another. Thus, the angular position of the mounting plate 16a can be easily adjusted without having to remove the base plate 14a, and only access to the upper surface at the retaining area 78a of the mounting plates 16a is required.

A third embodiment of the present invention is illustrated in FIGS. 19 through 27. Components of this third embodiment which are similar to components of the prior two embodiments will be given like numerical designations, with a "b" suffix distinguishing those of the third embodiment.

The binding 10b of this third embodiment differs from the prior two embodiments in that in the disengaging mode, the slide jaw assembly 20b is moved positively from the retaining position to the release position by movement of the lever 102b. Also, as will be described more fully later herein, the adjustable mounting plate 16b has attached thereto forward toe and rear heel foot supports that move adjustably with the mounting plate 16b.

As in the prior embodiment, each binding 10b comprises five main components, namely a base plate 14b, a mounting plate 16b, a fixed jaw 18b, a slide jaw assembly 20b and a boot plate 22b. The adjustable mounting of the mounting plate 16b to the base plate 14b is accomplished as in the second embodiment.

Also, as in the first two embodiments, there are the following components, namely a slide housing 58b, a locking arm 60b, a release control member 62b, two positioning springs 64b, an intermediate arm positioning spring 66b, and a pair of locating studs or bolts 68b.

In this third embodiment, the locking arm 60b is modified so that it has at its lower rear or outside end a downwardly extending retracting finger 200. Also, the outer upper surface portion of the mounting plate 16b is provided with an upwardly open recess 202 that has a forwardly positioned, downwardly and rearwardly extending cam face 204 that is engaged by the finger 200. In other respects, the slide housing 20b and the adjacent interacting portions of the mounting plate 16b are substantially the same as in the first two embodiments, except for the precise positioning of some of the components, primarily the positioning of the finger 200 relative to the locking finger 86.

Figure 20:
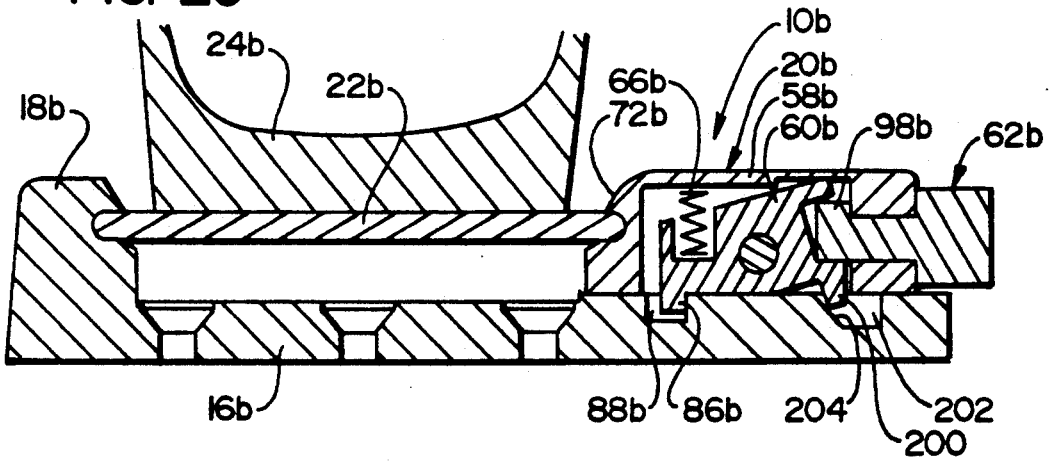
FIG. 20 is a sectional view taken along line 20—20 of FIG. 19, showing the binding in its locking mode.
Figure 21:
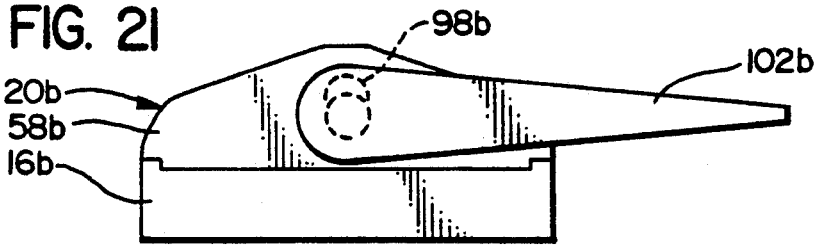
FIG. 21 is an end view taken from the right side of FIGS. 19 and 20.

To describe the operation of the third embodiment, reference is first made to FIG. 20, where the binding 10b is in its locking mode, with the locking finger 86b held within the locking recess 88b. In this position the handle 102b is positioned forwardly as in FIG. 21, and the binding 10b functions substantially in the first embodiment to hold the boot plate 22b securely locked in the binding 10b.

Figure 22:
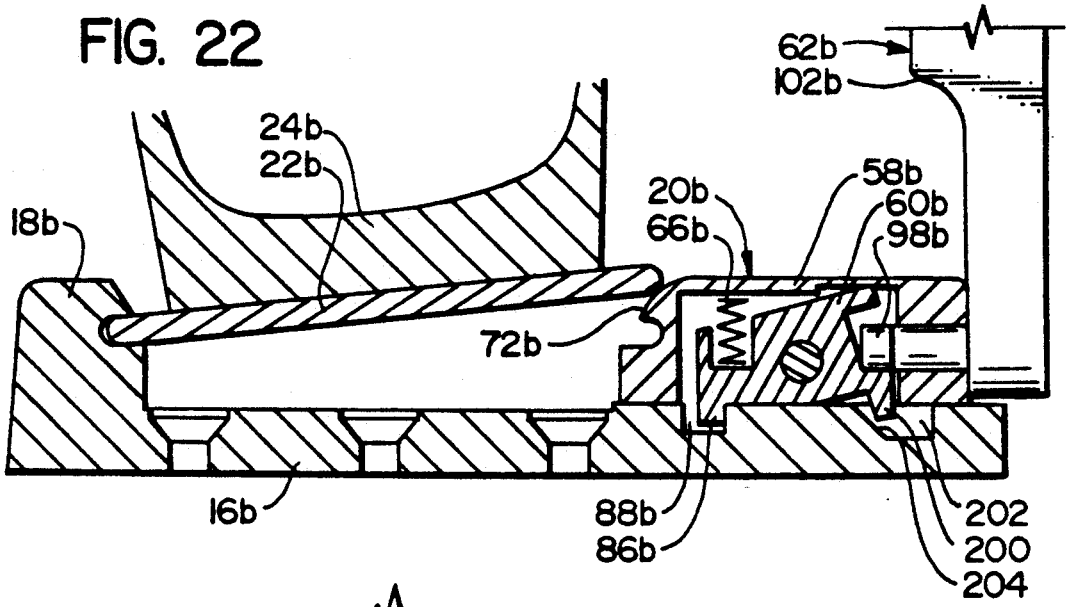
FIG. 22 is a sectional view similar to FIG. 20, except the binding is shown in its intermediate or step in mode.
Figure 23:
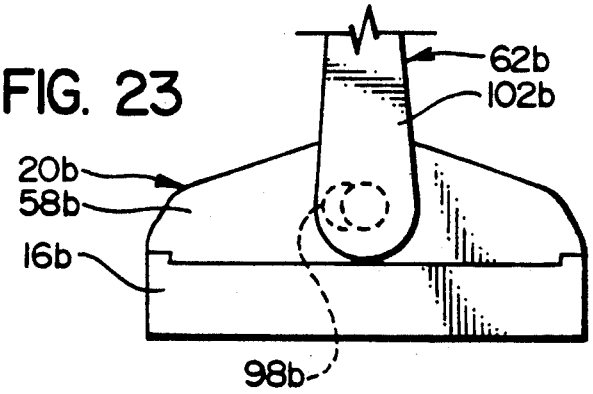
FIG. 23 is an end view similar to FIG. 21, except that the handle is positioned in the intermediate mode.
Figure 24:
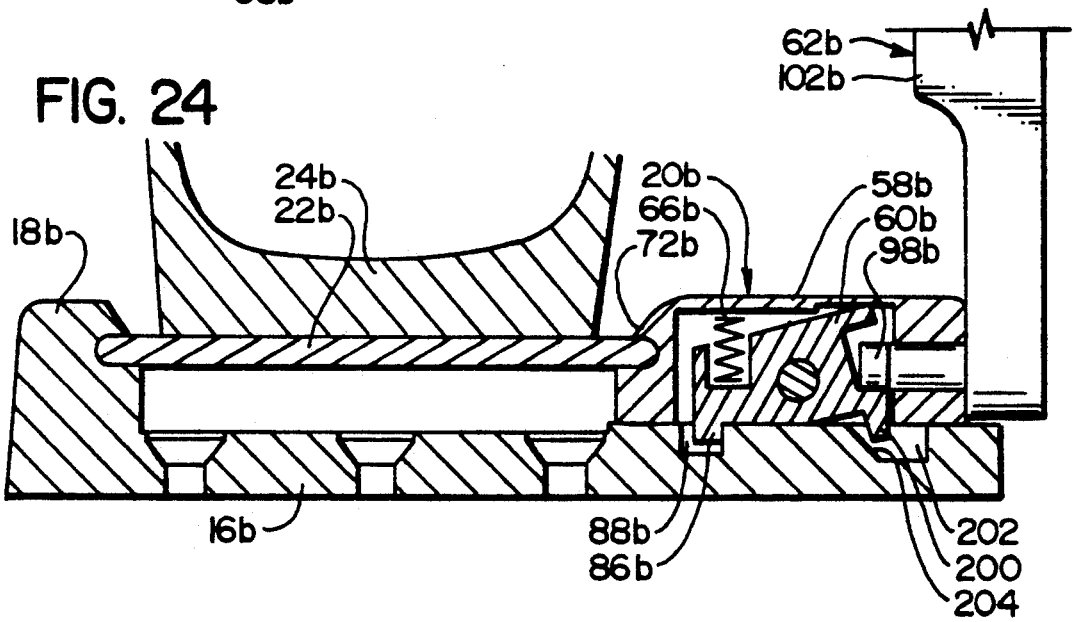
FIG. 24 is a view similar to FIG. 22, showing the binding in its intermediate mode, but with the slide jaw assembly having been shifted to the right by the boot plate and about to snap back to its boot retaining position.

In FIG. 22, it can be seen that the handle or lever 102b has been moved to the upwardly extending intermediate position, to permit the limited rotation of the locking arm 60b. It is in this intermediate position that the person can step into the binding 10b in a manner that the slide housing 58b will move outwardly to the right to permit the boot plate 22b to move into the retaining position, in the same manner as in the first embodiment. As shown in FIG. 24, the boot plate 22b has just cleared the slanted surface 72b of the slide housing 58b to permit the slide housing 58b to move back toward its retaining position to the boot plate 22b is in its retaining position. It will be noted that in this situation, as the movement of the slide housing 58b to the right lifts the locking finger 86b out of the locking recess 88b, there is clearance for the cam finger 200 to move into the recess 202. This operation is substantially the same as in the first embodiment.

Figure 25:
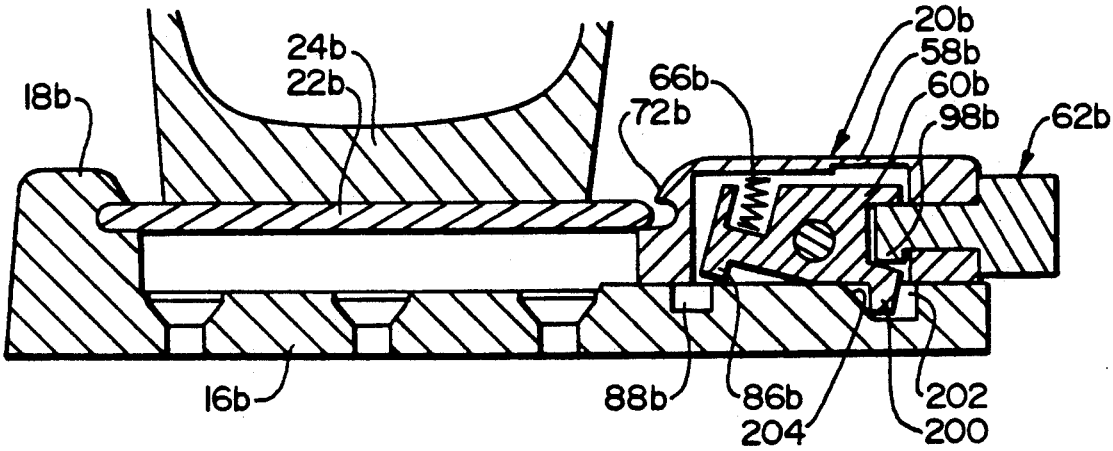
FIG. 25 is a view similar to FIGS. 20, 22 and 24, but showing the binding in its disengaging mode, where the slide jaw assembly has been moved to the release position.
Figure 26:
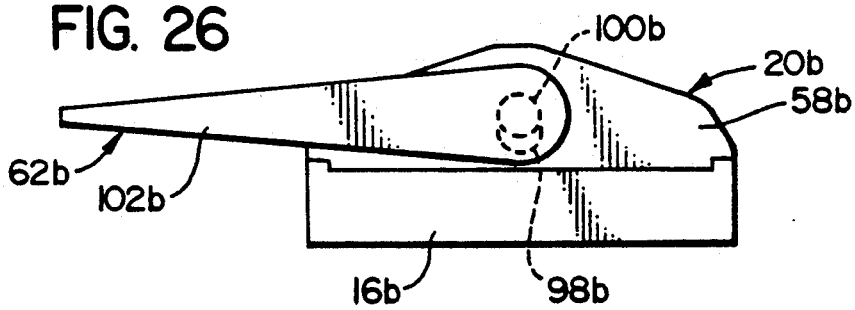
FIG. 26 is an end view similar to FIGS. 21 and 23, showing the handle in the disengaging mode.

Now, let us examine what occurs when the handle 102b is moved downwardly to the disengaging position. As the handle moves toward the position of FIG. 25, just as the locking finger 86b is moving out of its locking recess 88b, the lower front edge of the retracting cam finger 200 is beginning to engage the retracting cam surface 204. As the cam 96b moves to its full downward position, forcing the retracting finger 200 to its full downward position, the interaction of the finer 200 against the cam surface 204 causes the slide housing 58b to move to the right to its fully retracted position, as seen in FIG. 25. Thus, the person merely needs to step out of the binding to disengage the boot plate 22b from the binding 10b.

One of the advantages of this positive release in the disengaging position is as follows. In some circumstances, it may be that the person using the snow board is in a somewhat precarious position (e.g. immersed in a snowdrift) where the person needs to be disengaged from the snow board in order to be able to extricate himself out of the snowdrift. In this instance, if the person simply is able to manipulate the lever 102b, that makes total disengagement from the snow board bindings 10b, and the moderate twisting release motion of the foot that occurs in the prior two embodiments is not needed.

Figure 27:
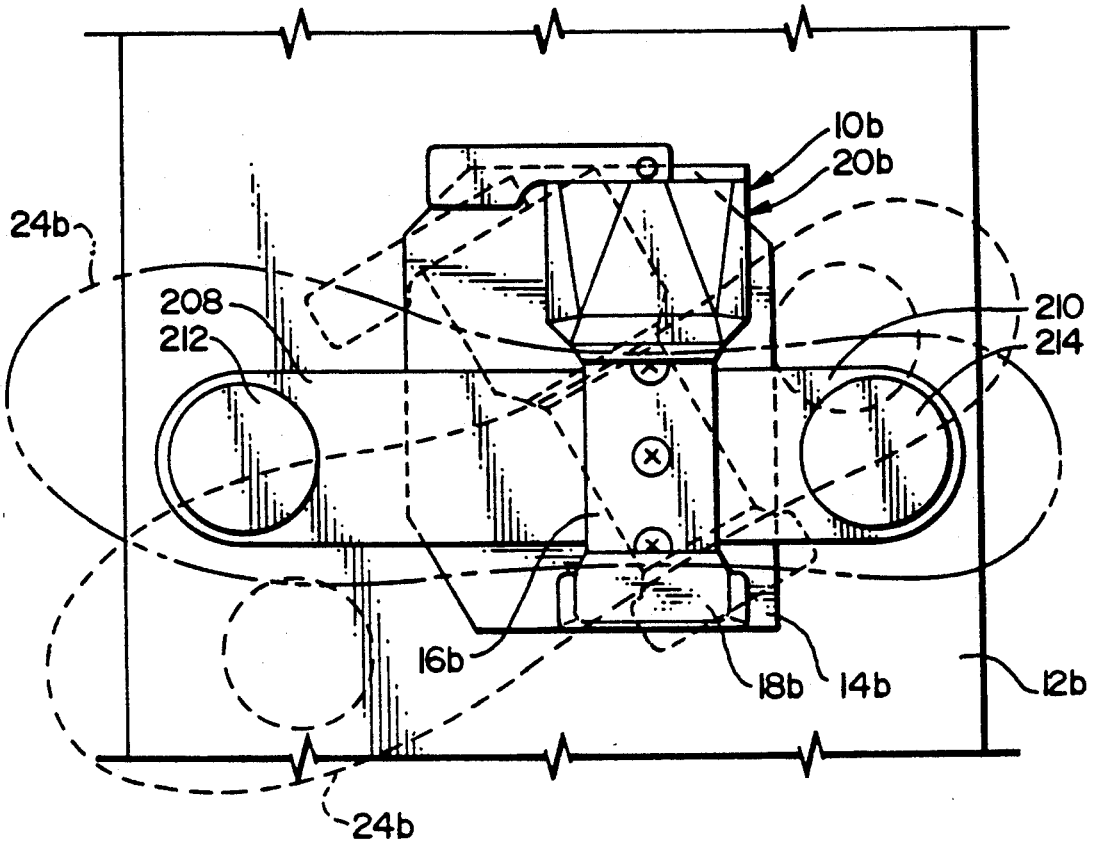
FIG. 27 is a top plan view similar to FIG. 13, showing the binding of the third embodiment of FIGS. 19 through 28 in different angular positions relative to the snow board.
Figure 28:
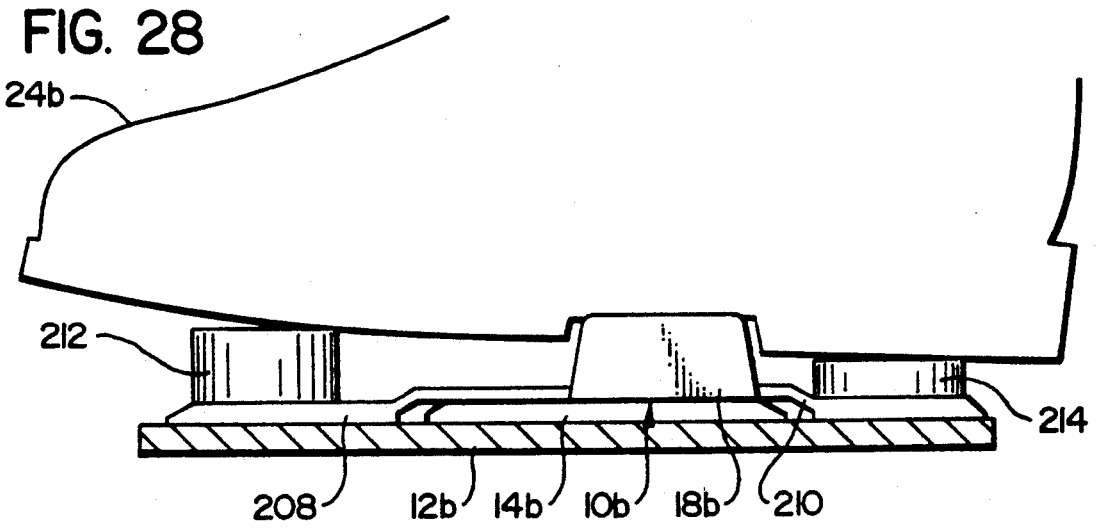
FIG. 28 is a side elevation view showing the overall binding of the third embodiment somewhat schematically in an elevation view.
Figure 29:
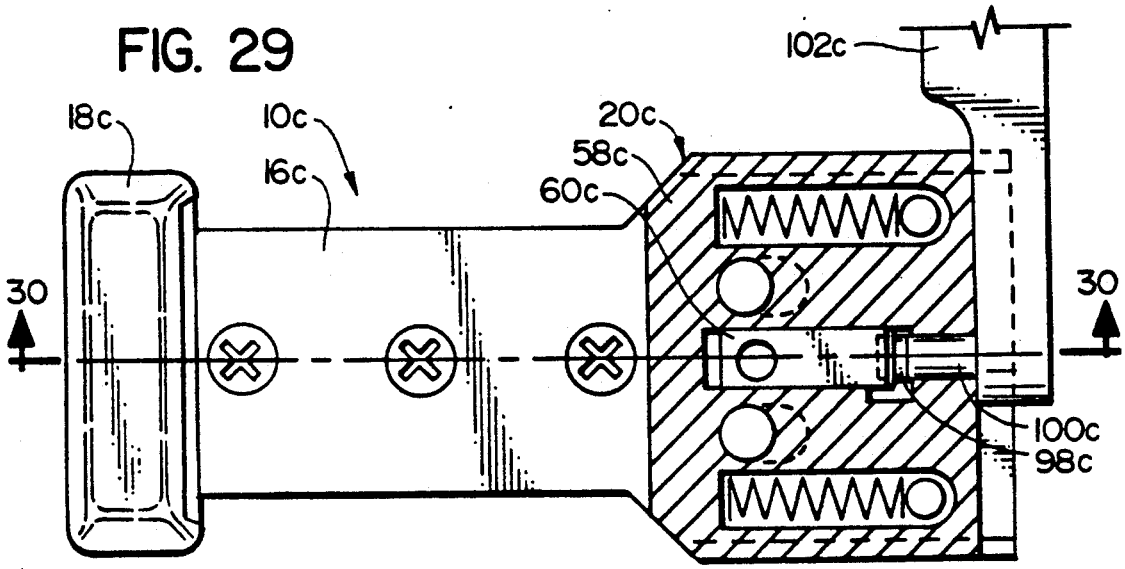
FIG. 29 is a top plan view showing the binding of a fourth embodiment of the present invention, this view being similar to FIG. 19.
Figure 30:
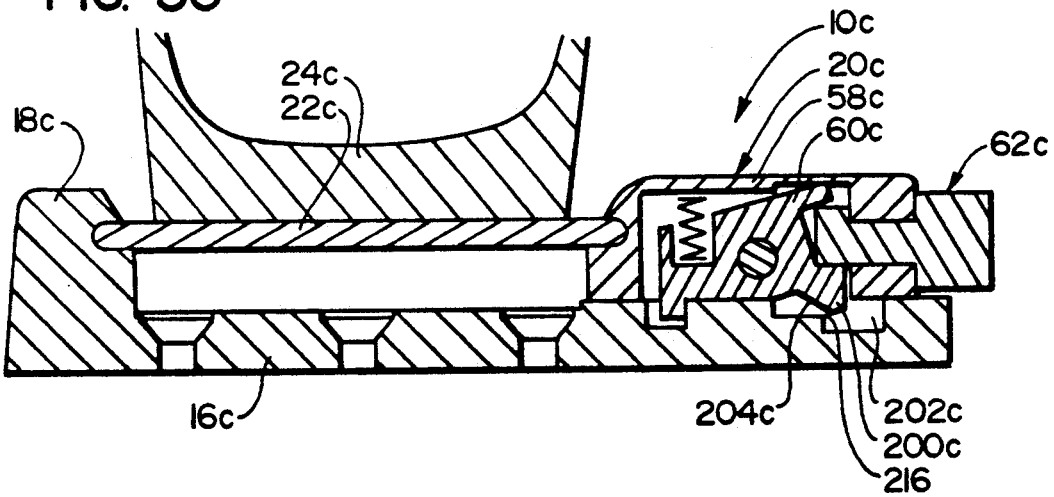
FIG. 30 is a view similar to FIG. 20, showing the binding of the fourth embodiment, this view taken along line 29—29 of FIG. 29, with the binding in its lock mode.
Figure 31:
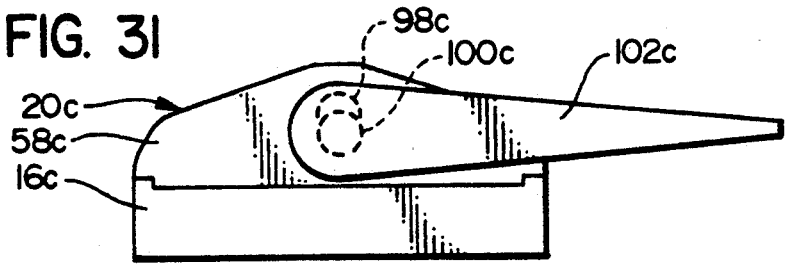
FIG. 31 is a view similar to FIG. 21, but showing the binding of the fourth embodiment with the lever in the position of the lock mode.

To describe another feature of this third embodiment, reference is made to FIGS. 27 and 28. The mounting plate 16b has fixedly connected thereto forward and rear plate extensions 208 and 210 respectively. Each of these extensions 208 and 210 has mounted thereto a small support disk or platform 212 and 214, respectively, the height of these platforms or disks 212 or 214 can be selected to give the proper angular position to the person's boot 24b. The manner of mounting the plate 14b is the same as in the second embodiment. However, in the present configuration when the mounting plate 16b is moved to a different angular position, the extensions 208 and 210, along with their platforms 212, and 214 are moved so that the platforms 212 and 214 are properly positioned to support the boot 24b.

A fourth embodiment of the present invention is illustrated in FIGS. 29 through 36. Components of this fourth embodiment which are similar to those of the earlier embodiments will be given like numerical designations, with a "c" suffix distinguishing those of the fourth embodiment.

This fourth embodiment 10c is substantially the same as in the third embodiment except that the arrangement of the retracting cam finger 200c is changed so that there is incorporated on the finger 200c itself the downwardly and rearwardly slanting cam surface 204c. The recess 202c is simply formed with an edge portion 216 that interacts with the cam surface 204c as the locking arm 60c rotates in the position of 32 to the position of 34, thus retracting the slide jaw assembly 20c in the same manner as described above relative to the third embodiment.

Figure 32:
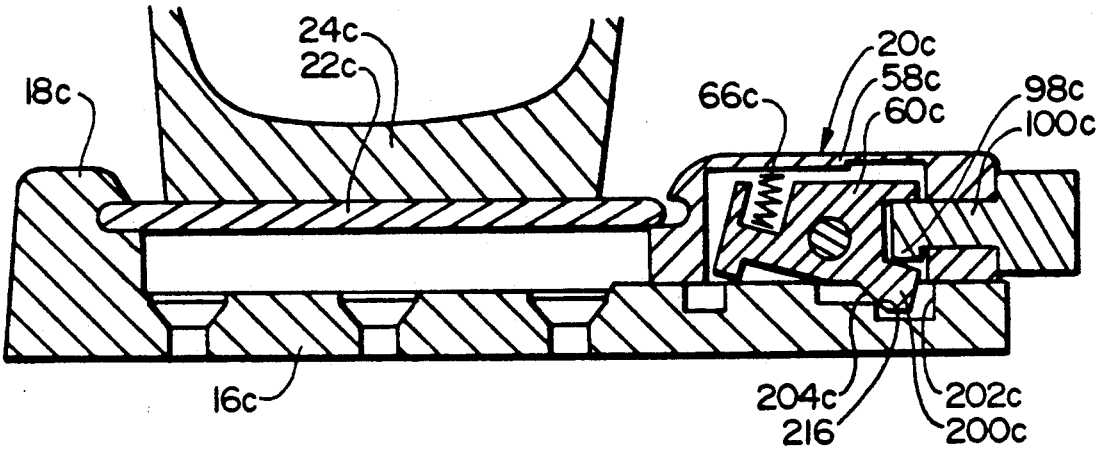
FIG. 32 is a sectional view similar to FIG. 30, but showing the binding in its disengaging mode, where the slide jaw assembly is moved positively to its release position.
Figure 33:
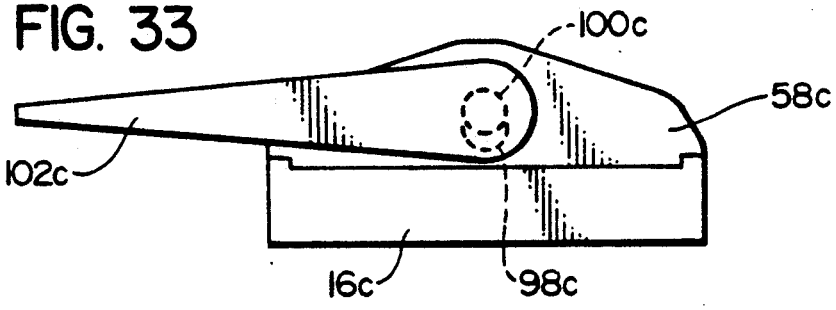
FIG. 33 is an end view similar to FIGS. 30 and 32, showing the lever positioned with the binding in its disengaging or release mode.
Figure 34:
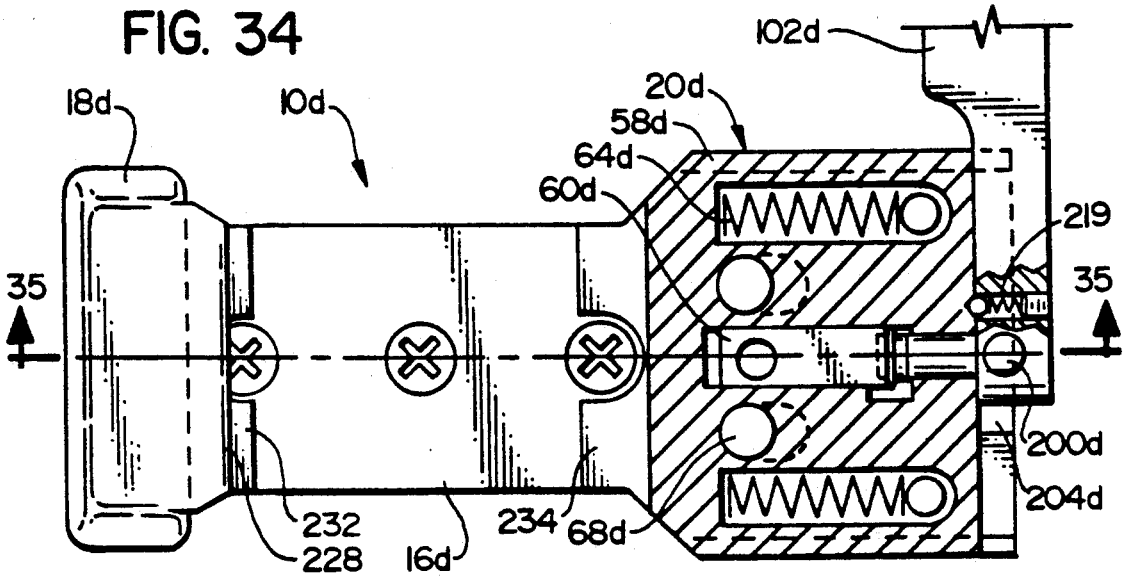
FIG. 34 is a top plan view of a fifth embodiment of the binding of the present invention, this view being similar to FIGS. 3, 19 and 29, with the binding in its locking mode.
Figure 35:
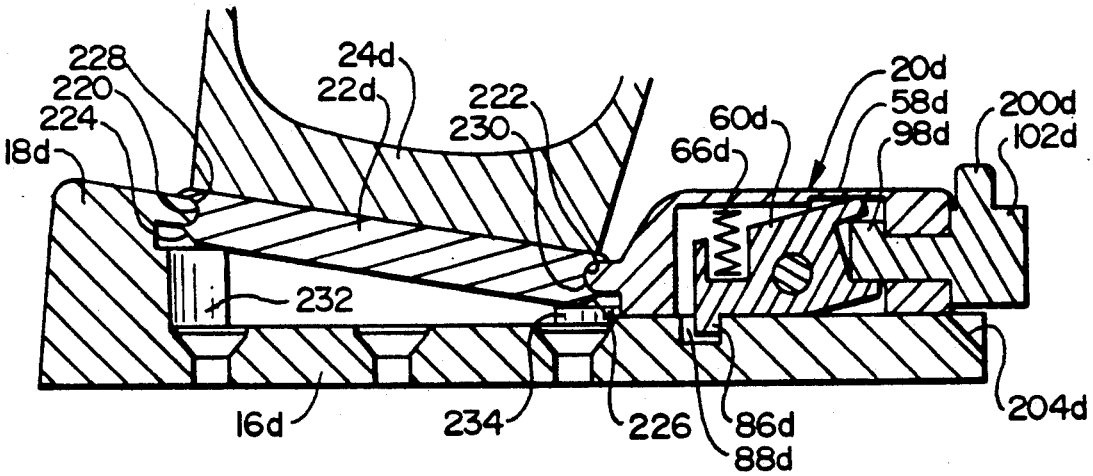
FIG. 35 is a sectional view taken along lines 35—35 of FIG. 34, with the binding in the locking mode.
Figure 36:
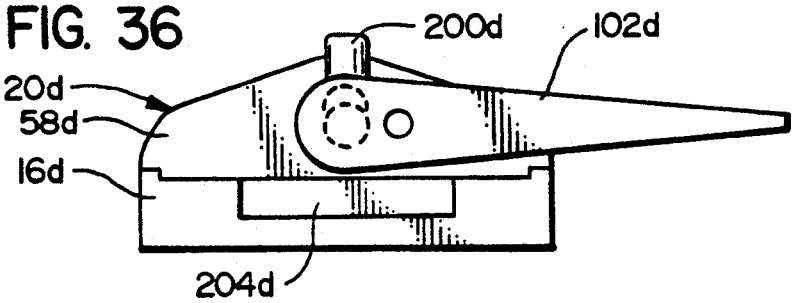
FIG. 36 is an end view of the binding of the fifth embodiment shown in FIGS. 34 and 35, with the handle being positioned with the binding in its lock mode.
Figure 37:
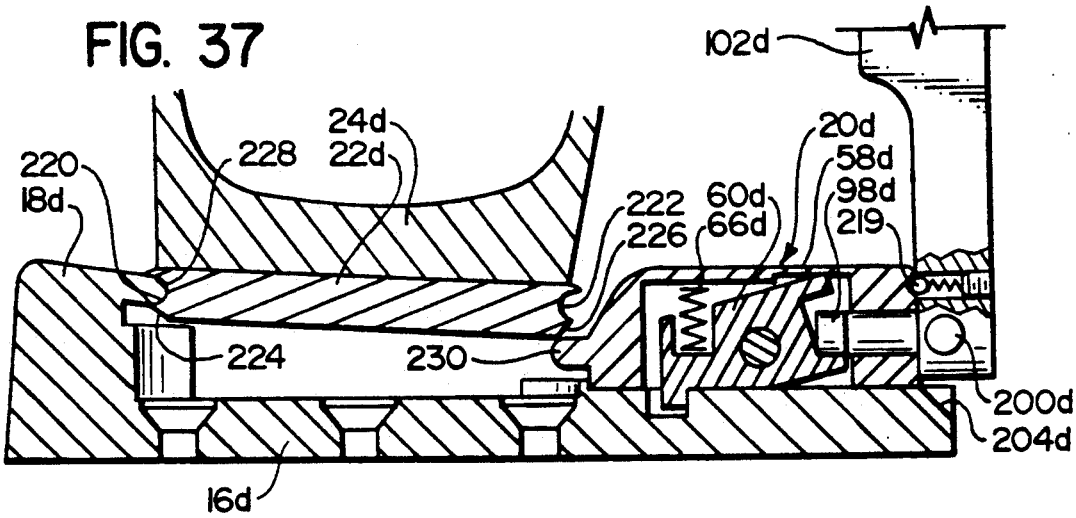
FIG. 37 is a sectional view of the fifth embodiment, similar to FIG. 35, but with the binding in its intermediate or step-in mode.
Figure 38:
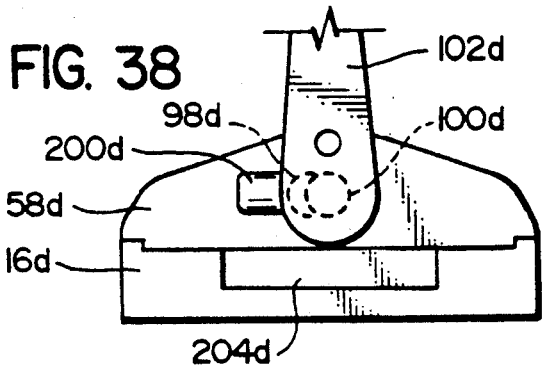
FIG. 38 is an end view similar FIG. 36, but with the handle in its upright position with the binding in its intermediate or step-in mode.
Figure 39:
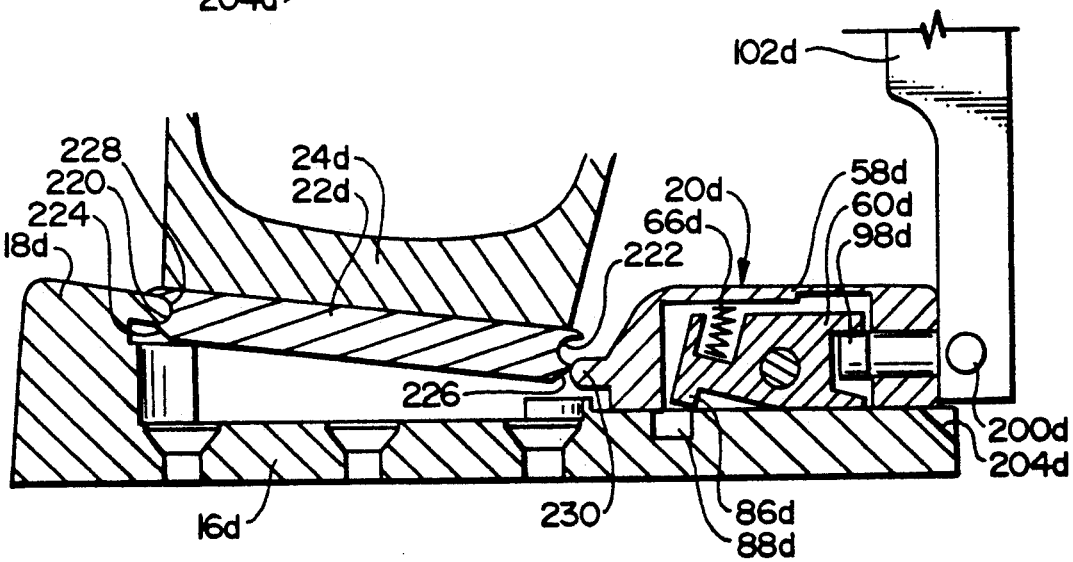
FIG. 39 is a sectional view similar to FIG. 37, but showing the slide jaw housing beginning to move to the right, with the boot plate moving toward its retained position in the binding.
Figure 43:
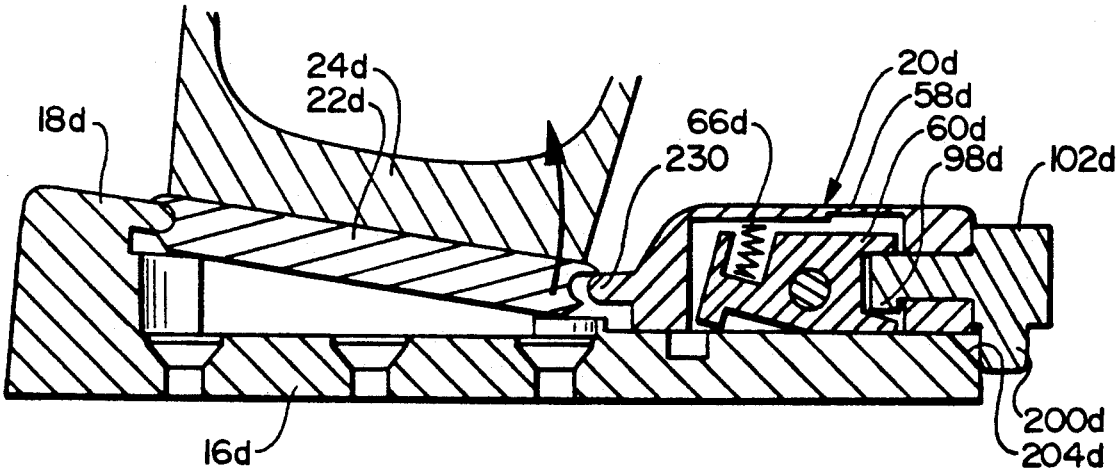
FIG. 43 is a sectional view similar to FIG. 42, but with the binding in its disengaging mode.
Figure 44:
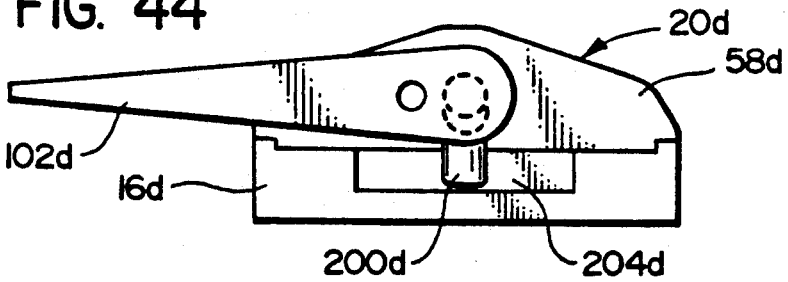
FIG. 44 is an end view similar to FIG. 42, showing the handle being moved to its horizontal position with the binding of the fifth embodiment in its disengaging mode.
Figure 45:
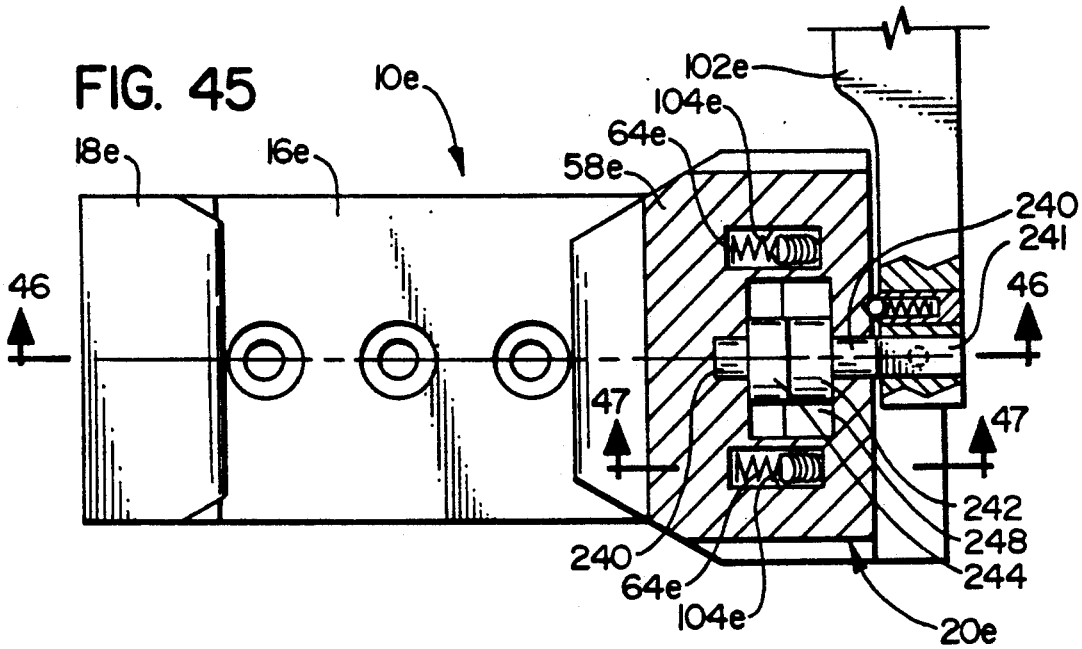
FIG. 45 is a top plan view, similar to FIG. 3, showing a sixth embodiment of the present invention in its locking mode.
Figure 46:
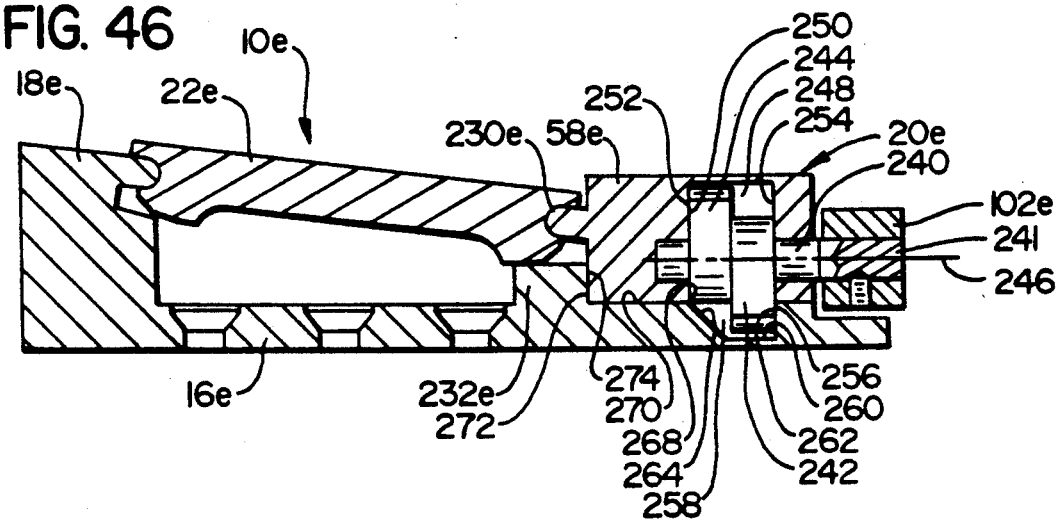
FIG. 46 is a sectional view taken along line 46—46 of FIG. 45.

It is readily apparent that the operation of this fourth embodiment is substantially the same as in the third embodiment, in that the lock mode and the intermediate mode operations are substantially the same as in the first embodiment. Then in going into the disengaging mode, the action of the cam surface 204c moves the slide jaw housing by positive engagement to the release position. Accordingly the intermediate position is not illustrated in the drawings, and only the disengaged position is shown in FIGS. 32 and 33.

The fifth embodiment of the present invention is illustrated in FIGS. 34 through 44. Components of this fifth embodiment which are similar to components of the prior embodiments will be given like numerical designations with a "d" suffix distinguishing those of the fifth embodiment.

This fifth embodiment is similar to the third and fourth embodiments in that movement of the lever arm or handle 102d to the disengaging position causes positive retraction of the slide jaw assembly 20d. However, the positioning and arrangement of the retracting cam mechanism is somewhat different. A second difference is the arrangement of the boot plate 22d with regard to the fixed jaw 18d and the slide jaw housing 58d.

In this fifth embodiment, the arrangement of the locking arm 60d, the positioning springs 64d, the spring 66d, and the positioning cam 98d are substantially the same as in the first embodiment, as shown in FIGS. 1 through 14. Accordingly, there will not be any detailed description of those components.

To describe the added features of this fifth embodiment, as indicated above retracting cam mechanism is somewhat different. More specifically, the retracting cam finger 200d is positioned at the root end of the handle or lever 102d so as to extend radially outwardly from the axis of rotation of the handle 102d. Further, the upper outside edge portion of the mounting plate 16d is formed with a beveled or slanted surface 204d to interact with the retracting cam finger 200d. As will be described below, as a handle 102d is moved from the intermediate position to the release position, the engagement of this finger 200d with the cam surface 204d causes the positive movement of the jaw housing 58d to the release position.

Also, a ball and detente positioning device 219 is provided near the base of the handle 102d to hold the handle 102d releasably in its three positions for the three operating mode.

Also, as indicated above, the mounting engagement of the boot plate 22d is somewhat different in this fifth embodiment, it can be seen that the boot plate 22d is formed at its side edges with two elongate lateral recesses 220 and 222. Extending downwardly and inwardly from each recess 220 and 222 is a related downwardly and inwardly slanting surface portion 224 and 226, respectively, and these surface portions are arranged to engage, respectively, an inwardly extending retaining ridge or lip 228 on the fixed jaw 18d and an opposite and matching ridge or lip 230 mounted to the slide jaw housing 58d. Thus, it can be seen that as the boot plate 22d is spaced just above the retaining position of the binding 10d, the surfaces 224 and 226 engage the matching ridge or lip members 228 and 230, so that as the boot 24d moves downwardly, it moves the slide jaw housing 58d to the right.

It can be seen that beneath the lip or ridges 228 there is a positioning block 212, and a similar block 234 is positioned below the lip or ridge 230. Thus, as the plate 22d moves into the retaining position, it is properly located by these blocks 232 and 234 so that the plate 22d is enabled to come into proper retaining engagement with the lips or ridges 228 and 230.

To describe the operation of this fifth embodiment shown in FIGS. 34 through 43, in the lock mode (see FIGS. 34, 35 and 36), the operation is substantially the same as in the prior embodiments. The locking arm 60d is held in its locking position with the boot plate 22d securely retained in its operating or retained position in the binding 10d.

The binding 10d in its intermediate mode is illustrated in FIGS. 37 through 40. It can be see in FIG. 37 that the person is about to step into the binding, and the left hand portion of the boot plate 22d has come into engagement with the jaw 18d, with the lip 228 being positioned in the boot plate recess 220. Now the right hand slanting surface 226 is coming into engagement with the retaining lip or ridge 230 which is made integrally with or fixedly attached to the slide jaw housing 58d. It can be seen in FIG. 39 that as the boot plate 22b moves further down, the slide jaw housing 58b begins movement to the right. At the same time, as in the first embodiment, the locking finger 86d is lifted out of its related locking recess 88d. This operation is substantially the same as in the first embodiment. Then, as illustrated in FIG. 40, when the boot plate 22d is in the retained position in the binding, the slide jaw housing 58 is caused by the positioning springs 64d to move to the left to engage the boot plate 22d.

To describe the operation of this fifth embodiment 10d relative to movement from the intermediate mode to the disengaging mode, it should first be noted that the overall operation is quite similar to the third and fourth embodiments shown in FIGS. 19 through 33, in that there is positive cam engagement to move the slide jaw housing 58d to the release position, without the necessity of any force being exerted by the boot plate 22d itself, as is the case in the first two embodiments shown in FIGS. 1 through 18.

With reference to FIG. 41, it can be seen that the handle 102d has been moved from the upright position of FIG. 40 downwardly toward the disengaging position. As this happens, the cam finger 98 begins engaging the right side of the locking arm 60d to lift the locking finger 86d out of the locking recess 88d. Then the cam finger 200d comes into engagement with the cam surface 204d which is a downwardly and outwardly slanting surface formed along the top upper lateral outside edge of the mounting plate 16d. This is illustrated in FIGS. 41 and 42. As the lever 102d is moved further downwardly from the position of FIGS. 41 and 42 to the position at FIG. 44, the engagement of the cam finger 200d with the surface 204d causes movement of the jaw housing 58d to the right and to the release position. It can be seen in FIG. 43 that the slide jaw housing 58d has moved totally to its release position, and the boot plate 22d is free to be moved away from the binding 10d.

A sixth embodiment of the present invention is illustrated in FIGS. 45 through 52A–C. Components of this sixth embodiment which are similar to the prior five embodiments will be given like numerical designations with an "e" designation distinguishing those of the sixth embodiment. As in the prior embodiments, the binding 10*e* comprises five main components. There is a base plate (not shown), a mounting plate 16*e*, a fixed jaw 18*e*, a slide jaw assembly 20*e*, and a boot plate 22*e*. The mounting plate, the fixed jaw 18*e* and the boot plate 22*e* are substantially the same as in the fifth embodiment, so there will be no detailed description of these. Further, the ridge or lip 230*e* that is part of the slide jaw assembly 20*e* is the same as in the fifth embodiment, in the manner in which it interacts with and engages with the boot plate 22*e*.

The basic operation of this sixth embodiment is similar to the prior embodiments, in that there are three operating modes, namely the lock mode, the intermediate (or step in) mode, and the disengaging mode. Further, this sixth embodiment is similar to the third, fourth and fifth embodiments in that the disengaging or release mode, there is positive engagement of the operating components to move the slide jaw housing 20*e* positively to the release position in the disengaging mode. Also, there is an operating handle or lever 102*e* which is moved between the three operating positions to place the binding 10*e* in a selected one of its three operating modes.

To describe in more detail the present invention, the slide jaw assembly 20*e* comprises a slide jaw housing 58*e* and a pair of positioning springs 64*e*, each positioned in related spring recesses 104*e*. As in the prior embodiments, these positioning springs 64*e* resiliently urge the slide jaw housing 58*e* inwardly toward the retaining position. However, it will be noted that there is not in this sixth embodiment a locking arm, such as shown at 60 in the first embodiment and 60 "a" through "d" in the second to fifth embodiments.

Attached to the handle 102*e* is a shaft 100*e* that extends through the outside wall of the slide jaw housing 58*e*. The mounting portions 240 of the shaft 240 are cylindrical and the other portions 241 have in cross section a square configuration and mounted to this operating end 240 so as to extend radially outwardly therefrom are a locking finger 242 and a positioning cam finger 244. The fingers 242 and 244 extend outwardly from the center axis 246 of the shaft 100 in diametrically opposed directions. As will be described later herein, by rotating the handle 102*e* to move the locking finger 242 downwardly into the mounting plate 16*e*, the slide jaw housing 58*e* is held in its lock mode or position. On the other hand by operating the handle 102*e* to move the positioning cam finger 244 downwardly into the mounting plate 16*e*, the slide jaw housing 58*e* is moved outwardly to the disengaged position of the disengaging or release mode.

The central portion of the slide jaw housing 58*e* is formed with a downwardly open recess 248 that is dimensioned so as to be able to receive both of the fingers 242 and 244 rotating upwardly therein. The forward wall 250 of the recess 248 is aligned transversely to the shaft axis 246 and is immediately adjacent to the forward surface 252 of the positioning cam finger 244. The rear wall 254 of the recess 248 is also transversely aligned to the shaft axis 248 and is positioned so as to be immediately adjacent to the outside surface 256 of the locking finger 242.

The right or outside end of the mounting plate 16*e* is formed with an upwardly open recess 258 that is, with the slide jaw housing 58*e* in its left or inside retaining position, directly below the recess 248. This recess 258 has a right or outside bottom surface portion 260 that is horizontally aligned and is sufficiently low so as to permit the locking finger 242 to rotate to its downwardly extending position. Also, the right or outside surface 262 of the recess 258 is transversely aligned relative to the shaft axis 246 and is positioned immediately adjacent to the right or outside surface 256 of the locking finger 242.

Immediately to the left or inwardly from the bottom recess surface 260, there is a slanted surface portion 264 that functions as a cam surface that interacts with the positioning finger 244 to move the slide jaw housing 58*e* from its left retaining position to the right (or outwardly) to the disengaged position of the disengaging mode. This cam surface 64 extends from the front edge of the surface 260 upwardly and inwardly (i.e. to the left) to terminate at the upper edge 268 at an upper surface 270 of the mounting plate 16*e*. At the left or inside surface 272 of the slide jaw housing 58*e*, there is a platform or abutment 234*e* having an outwardly facing surface 274 which, with the slide jaw housing 58*e* in its inner locking position abuts against the surface 272 of the slide jaw housing 58*e*.

Figure 47:
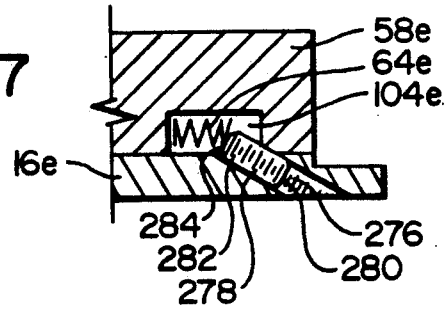
FIG. 47 is a sectional view taken along line 47—47 of FIG. 45.

The arrangement of the positioning spring 64*e* will now be described with reference to FIG. 47. The mounting plate 16*e* has for each spring 64 an upwardly and inwardly reaching cylindrical interiorly threaded recess or socket 276 in which is threaded a positioning screw 278. The outside end 280 of each screw 278 is formed with a contoured recess to receive an Allen wrench or the like so that the screw 278 can be rotated to the appropriate position. The forward end 282 of the screw 278 engages the rear end 284 of the positioning spring 24*e* to cause the spring to be compressed and thus bear against the slide jaw housing 58*e*, in the manner of the prior embodiments. The opposite side of the mounting plate 16 has a second socket 276 and screw 278 to position the other positioning spring 64*e*.

Figure 48:
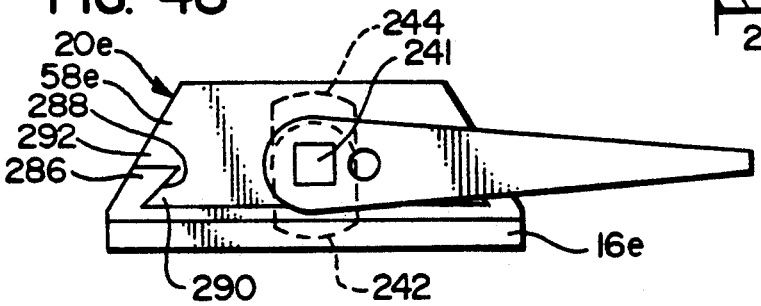
FIG. 48 is an end view of the binding of FIG. 45, with the handle in its locking position.

Also, the slide mounting of the slide jaw housing 58 is modified from the prior embodiments. As shown in FIG. 48, the mounting plate 16*e* has a pair of parallel slide members 286, positioned on opposite edges of the mounting plate 16*e*. Each of these members 286 has a slanted or dovetail slot 288 in which fits a matching tongue portion 290 of the slide jaw housing 58*e*. Also, the opposite sides of the housing 58*e* has an outwardly extending shoulder portion 292 which fits against the top side of the member 286.

To describe the operation of this sixth embodiment, reference is now made to FIGS. 49A–49B through 52A–52B. FIGS. 49A through 52B are sectional views taken along a vertical plane coinciding with the shaft axis 246. FIGS. 49B through 52B are transverse sectional views taken along plane indicated at 49A.

Figure 49A:
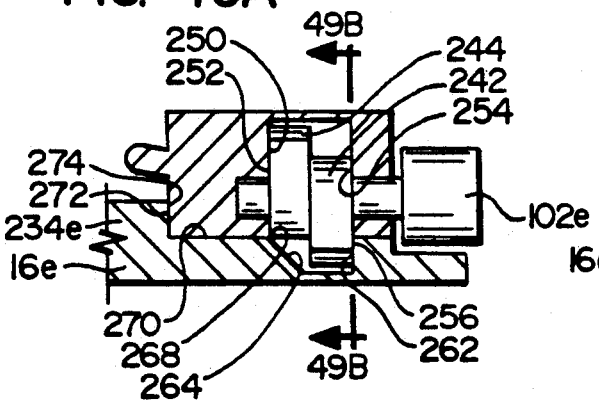
Figure 49B:
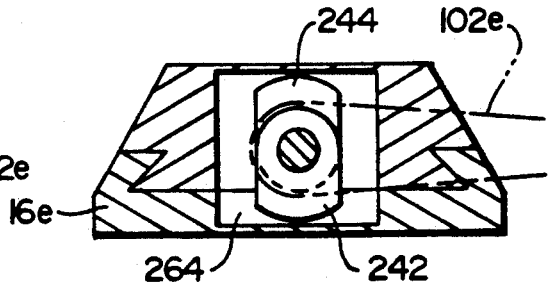

FIGS. 49A and 49B show the binding 10*e* in its lock mode. It can be seen that the handle 102*e* is positioned horizontally, and the locking finger 242 extends straight downwardly, so that its outside surface 256 abuts the surface 262 in the recess 258 of the mounting plate 16*e*. Further, the cam finger 244 extends upwardly so that its inwardly facing surface 252 abuts the surface 250 of the upper recess 248. Also, the inner facing surface 272 of the slide jaw housing 58*e* abuts the surface 274 of the platform 234*e* that is fixedly connected to the mounting plate 16e. It is readily apparent from examining FIG. 49A that the slide jaw housing 58e is fixedly located in its locking position.

Figure 50A:
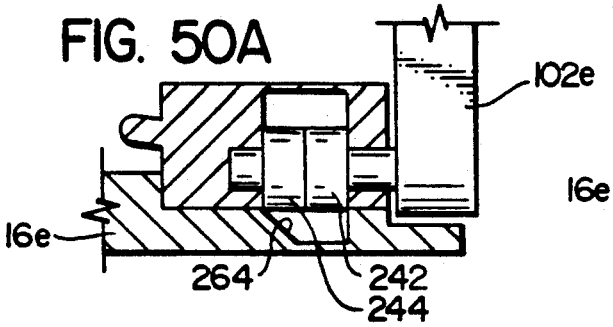
Figure 50B:
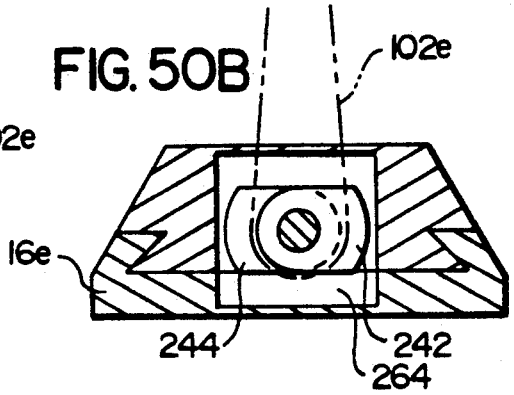
Figure 51A:
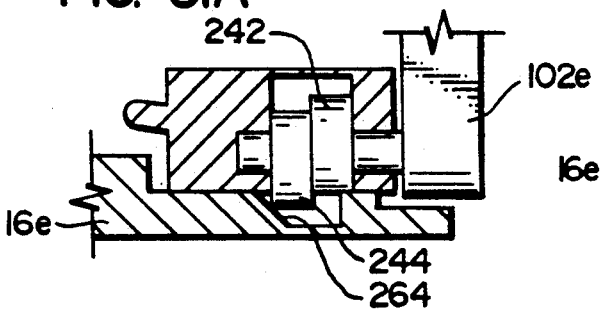
Figure 51B:
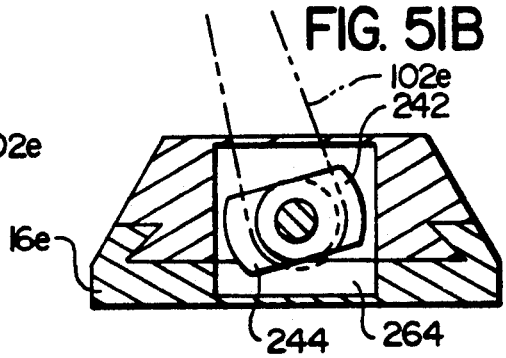

FIGS. 50A and 50B show the binding 10e in the intermediate or step-in mode. It can be seen in FIG. 50B that the handle or lever 102e has been rotated ninety degrees from the position of 49b to the upright position, and the locking and cam fingers 42 and 44 are extending horizontally. It is readily apparent that in this intermediate position the slide jaw housing 58e is urged by the positioning springs 64e inwardly to the retaining position, but that the slide jaw housing 58e can be moved outwardly to the right against the urging of the springs 64e to a non retaining or release position. It is readily apparent from the description of the prior embodiments that in this configuration, the person can step into the binding simply by placing the boot plate 22e in engagement with the fixed jaw 18e and then pushing the opposite end of the boot plate 22e downwardly to move the slide jaw housing 58e to the right, after which it will snap back into the retaining position to hold the boot plate 22e. After that, the handle or lever 102e can be rotated downwardly to the locking position 49A/49B.

Figure 52A:
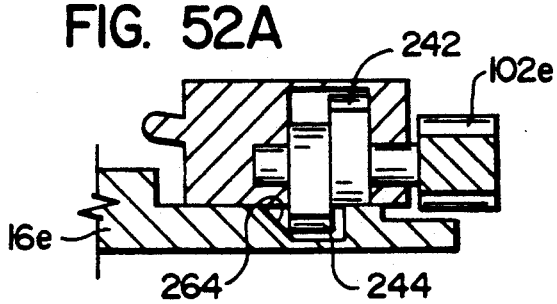
Figure 52B:
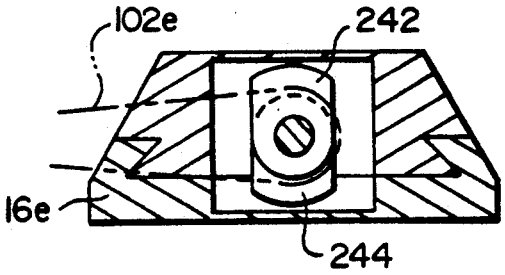

To describe the transition from the intermediate or step-in position of FIGS. 50A–50B to the disengaging position which is illustrated in FIGS. 52A–52B, reference is first made to 51A and 52B. In 51A and 52B, the handle 102e has been moved a short distance away from the upright position so that the cam finger 244 is starting to engage the slanted cam surface 264. At the same time, the locking finger 242 is simply moving upwardly and is out of operating engagement. With further rotation of the handle 102e, the cam finger 244 moves downwardly and continues to move the slide jaw housing 58e outwardly to the right. When the cam FIG. 244 is in its full down position, it can be seen from examining FIGS. 52A and 52B that the slide jaw housing 58e has moved to the full release position. It is evident from review of the prior embodiments that in this position, the boot plate 42e can simply be lifted away from the binder 10e.

Figure 49C:
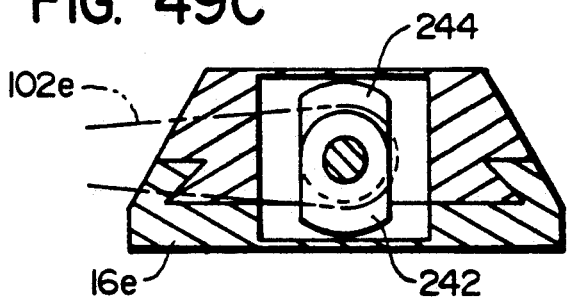
Figure 50C:
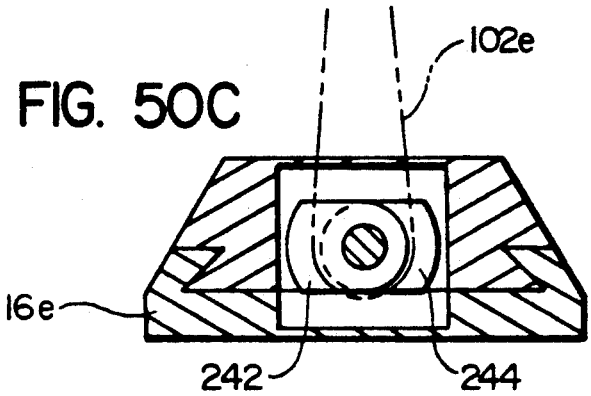
Figure 51C:
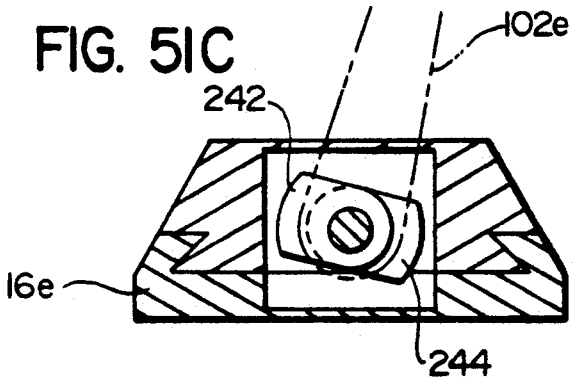
Figure 52C:
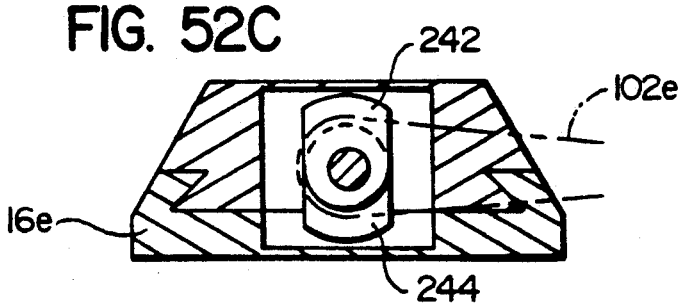

To illustrate another facet of this sixth embodiment, reference is made to FIGS. 49C through 52C, which correspond to FIGS. 49B through 52B. In the arrangement of FIGS. 49C–52C, the handle 102e has been removed from the square shaft end at 241 (shown in FIG. 248) and rotated 180° so that, as can be seen in FIG. 49C, the handle 102e extends in the opposite direction than in FIG. 49B. In the arrangement, to move the handle 102e from the locking position of FIG. 49C upwardly to the intermediate position of FIG. 50C and then down to the release position of FIG. 52C, the handle 102e is moved in a counter-clockwise direction, as opposed to the clockwise direction of FIGS. 49B–52B.

The significance of this arrangement is that the identical binding can be used for both the right and left feet, with the handle 102e extending forwardly. The only change that need be made is to change the position of the handle 102e relative to the shaft 100e. It is readily apparent from examining FIGS. 49C through 52C that the locking finger 242 and positioning finger 244 operate in the same manner, but simply with an opposite direction of rotation.

Figure 53:
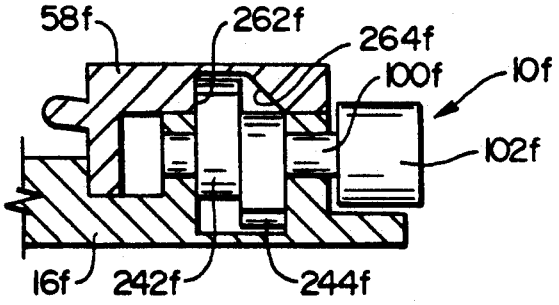
FIG. 53 is a sectional view similar to FIG. 49A, but with a reversal of parts where the control shaft is mounted in the mounting plate and the locking finger and cam member come into engagement with a recess formed in the jaw assembly housing.

FIG. 53 shows a seventh embodiment of the present invention which is quite similar to the sixth embodiment of FIGS. 45 through 52A–C, except that there is a reversal of parts. Components of this seventh embodiment will be given numerical designations similar to the sixth embodiment, but with an "f" suffix distinguishing those of this seventh embodiment.

Figure 3:
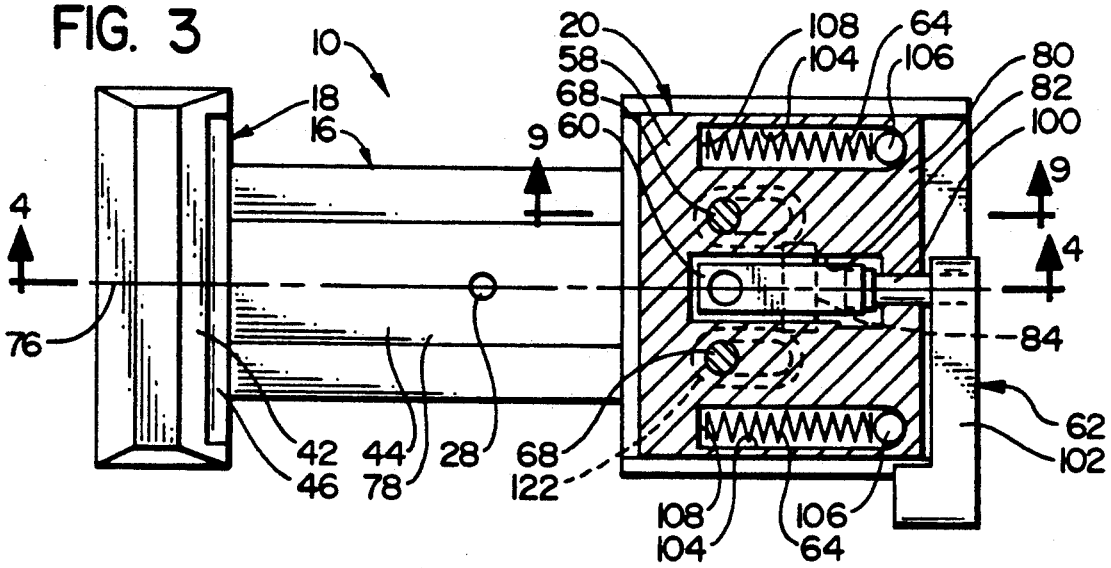
FIG. 3 is a top plan view of the mounting plate of the first embodiment, along with the components mounted thereto, and with a portion thereof shown in section along a horizontal plane.

In this seventh embodiment, the shaft 100f along with the locking finger 242f and the positioning finger 244f is mounted to the mounting plate 16f. The cam surface 264f is mounted in an upper recess in the slide jaw housing 58f. In the position of FIG. 3, the locking finger 242f extends upwardly so as to engage the adjacent surface 262f of the slide jaw housing 58f to hold the slide jaw housing 58f in its retaining position. It is also evident that by rotating the shaft 100f 90°, the fingers 242f and 244f extend laterally in the intermediate step-in position. A further rotation of 90° causes the positioning finger 244f to engage the cam surface 264f and move the slide jaw housing 58f by positive engagement to the release position.

An eighth embodiment of the present invention is shown in FIGS. 54A and 54B through 56A and 56B. Components of this eights embodiment which are similar to embodiments will be given like numerical designations, with an "g" distinguishing those of the eight embodiment.

Figure 54A:
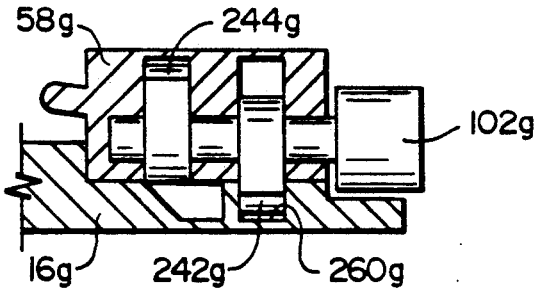
FIGS. 54A, 55A and 56A are similar to FIGS. 49A, 50A and 52A, respectively, showing yet a seventh embodiment of the present invention.

This eighth embodiment shown in FIGS. 54A/B through 56A/B is substantially the same as the sixth embodiment, except that the locking finger 242g is spaced a short distance from the positioning finger 244g and moves into a separate locking recess 260g'.

Figure 54B:
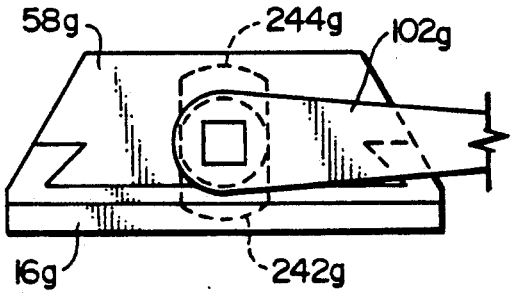
FIGS. 54B, 55B and 56B are end views, corresponding to FIGS. 54*a*, 55*a*, and 56*a*, respectively, and showing the control handle in the appropriate position corresponding to the operating mode as shown in the corresponding FIGS. 54A, 55A, and 56A.
Figure 55A:
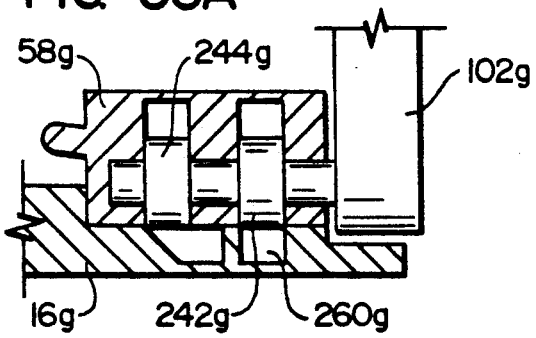
Figure 55B:
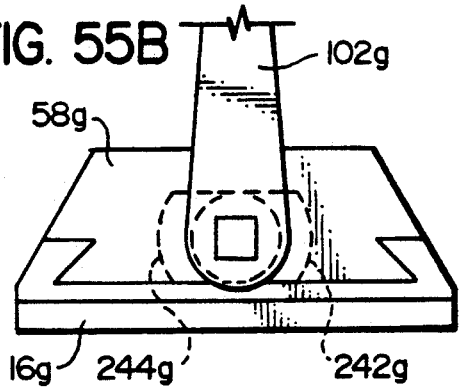
Figure 56A:
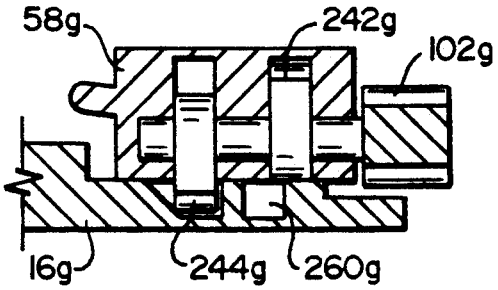
Figure 56B:
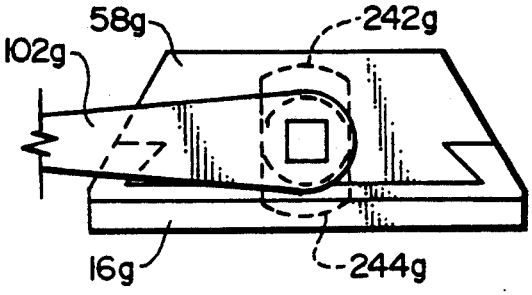

It can be seen that in FIGS. 54A and 54B, the binding 10g is in the locking mode, and that in 55A and 55B the handle 102g has been rotated 90° so that the binding 10g is in the intermediate "step-in" mode. In FIGS. 56A and 56B, it can be seen that the binding 10g is in the disengaging or release mode.

Figure 57:
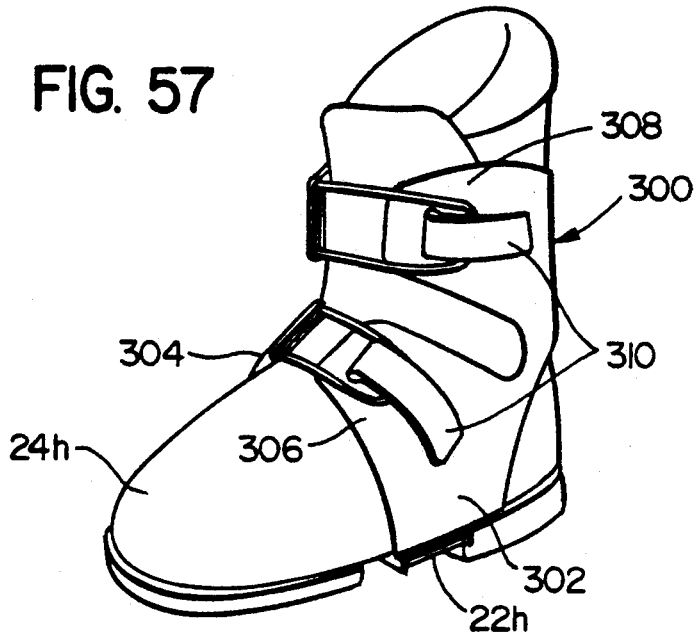
FIG. 57 is an isometric view showing a harness attachment by which a boot plate usable in the present invention can be secured to a boot.
Figure 58:
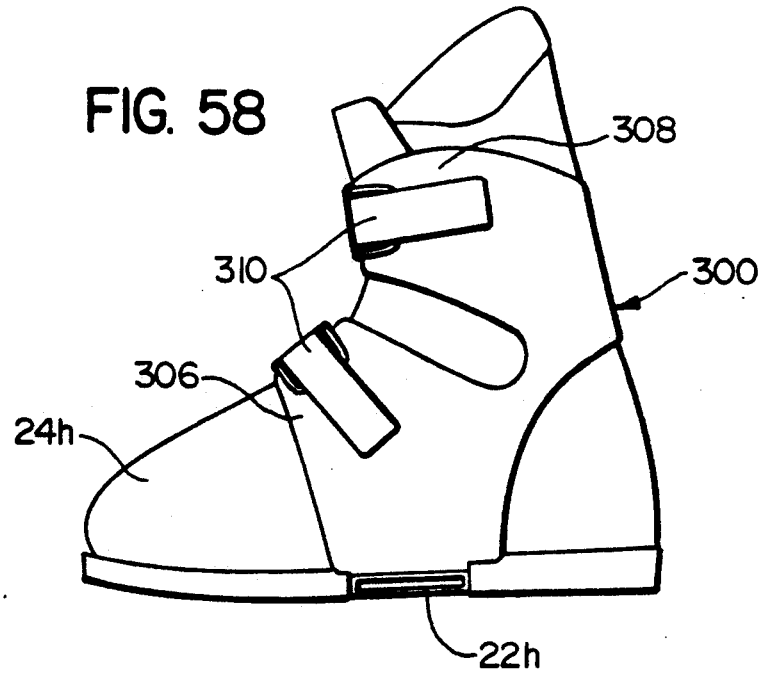
FIG. 58 is a side elevational view of the boot and harness of FIG. 57.

In FIGS. 57 and 58, there is shown a boot harness 300 which can be attached to a boot 24h so as to rigidly secure the mounting plate 22h to the boot 24h. This harness 300 comprises right and left straps 302 and 304. Each strap 302/304 comprises a lower strap portion 306 which extends over the top portion of the person's boot adjacent to the ankle. Then there is an upper strap portion 308 that extends from the rear ankle portion of the boot toward the forward ankle portion of the boot. Both sets of straps 306 and 308 can be pulled tight by an adjusting buckle mechanism 310 which is or may be similar to adjustable tightening buckles that are now used in conjunction with ski boots or the like.

It is evident that various modifications could be made to the embodiments of the present invention, without departing from the basic teachings thereof. Also, it is evident that various features of the embodiment shown could be recombined in various combinations, along with other components being added without departing from the basic teachings of the present invention.

What is claimed:

1. A binding assembly adapted to hold a person's boot in an operating location on a snow board or the like and to permit release of said boot, said binding assembly having a retaining position and a release position, said binding assembly having three operating modes, namely:

a. a first locking operating mode where said boot is fixedly held in said operating location by the binding in its retaining position;

b. a second intermediate operating mode where movement of said assembly from the retaining position to the release position is yieldingly resisted in a manner to permit movement of said boot into the operating location of the binding assembly and into retaining engagement therewith;

c. a third release operating mode where said assembly is either at, or easily movable to, said release position to permit easy removal of said boot from said operating location, said binding assembly comprising:

a. a base mounting means;

b. a jaw means that is mounted to said base mounting assembly so as to be movable between a boot retaining position engaging said boot at said operating location and a boot release position spaced from said boot retaining position;

c. a locking means having a locking position where said locking means is in operative locking engagement between said jaw means and said base mounting means to prevent movement of said jaw means from said boot retaining position to said boot release position and a lock release position where said locking means is out of said operative locking engagement;

d. spring means to urge said jaw means toward said retaining position; and e. selectively operable positioning and control means operably engaging said locking means and movable between first, second and third control mode positions to place said assembly in said first, second and third operating modes, respectively, as follows:

i. in said first control mode position to place said locking means in said locking position to prevent movement of said jaw means from said boot retaining position;

ii. in said second control mode position to place said locking means in said lock release position and to permit said spring means to urge said jaw means to said boot retaining position;

iii. in said third control mode position to limit the effect of the spring means to either move said jaw means to the boot release position or to at least partly limit effect of said spring means so that said jaw means can, with less resisting force from said spring means, move to said boot release position.

2. The assembly as recited in claim 1, wherein said binding assembly is arranged with surface entry means to guide a boot plate means of said boot into the operating location in said assembly, and said assembly is arranged so that with said assembly in said intermediate operating mode, engagement of said boot plate means with said surface entry means in moving toward said operating location causes movement of said jaw means away from said boot retaining position, and said jaw means returns to said boot retaining position when said boot plate means is at said operating location.

3. The assembly as recited in claim 1, wherein said locking means comprises a locking finger means moveably mounted to one of said jaw means and said base mounting means so as to be movable into abutting locking relationship with the other of said jaw means and said base mounting means.

4. The assembly as recited in claim 3, wherein said locking finger means is movable into a recess in the other of said jaw means and said base mounting means to be in said locking position.

5. The assembly as recited in claim 4, wherein said positioning and control means comprises a rotatable shaft, and said finger means is mounted to, and rotatable with, said shaft.

6. The assembly as recited in claim 1, wherein said positioning and control means comprises a cam member mounted to one of said jaw means and said base mounting means, and the other of said jaw means and said base mounting means has a cam surface, said cam member being movable to engage said cam surface in a manner to cause said jaw means to move from said boot retaining position to said boot release position.

7. The assembly as recited in claim 6, wherein said positioning and control means comprises a shaft rotatably mounted in one of said jaw means and base mounting means, and said cam member is mounted to said shaft to be rotatable therewith.

8. The assembly as recited in claim 1, wherein a. said locking means comprises a locking finger means moveably mounted to one of said jaw means and said base mounting means so as to be movable into abutting locking relationship with the other of said jaw means and said base mounting means;

b. wherein said positioning and control means comprises a cam member mounted to one of said jaw means and said base mounting means, and the other of said jaw means and said base mounting means has a cam surface, said cam member being movable to engage said cam surface in a manner to cause said jaw means to move from said boot retaining position to said boot release position.

9. The assembly as recited in claim 8, wherein said positioning and control means comprises a rotatable shaft, and said finger means and said cam member are mounted to, and rotatable with, said shaft.

10. The assembly as recited in claim 9, wherein said jaw means comprises a jaw housing mounted for substantially horizontal linear motion between said boot retaining position and said boot release position, and said shaft means is rotatably mounted to one of said base mounting means and said jaw housing.

11. The assembly as recited in claim 10, wherein said locking finger means and said cam member are positioned within said jaw housing.

12. The assembly as recited in claim 10, wherein said locking finger means is positioned within said jaw housing, and said cam member is positioned exteriorly of said jaw housing.

13. The assembly as recited in claim 10, further comprising a manually operable control handle moveable between three operating positions, namely a first position to place said assembly in the locking operating mode, a second position to place the assembly in the intermediate operating mode, and a third position to place the assembly in the release operating mode, said handle being operably connected to said rotatable shaft.

14. The assembly as recited in claim 3, wherein said jaw means is mounted to said base mounting means for substantially horizontal linear motion between said boot retaining position and said boot release position.

15. The assembly as recited in claim 14, wherein said locking means comprises a locking finger means moveably mounted to one of said jaw means and said base mounting means so as to be movable into abutting locking relationship with the other of said jaw means and said base mounting means.

16. The assembly as recited in claim 15, wherein said locking finger means is movable into a recess in the other of said jaw means and said base mounting means to be in said locking position.

17. The assembly as recited in claim 14, wherein said positioning and control means comprises a rotatable shaft, and said finger means is mounted to, and rotatable with, said shaft.

18. The assembly as recited in claim 17, wherein said positioning and control means comprises a cam member mounted to one of said jaw means and said base mounting means, and the other of said jaw means and said base mounting means has a cam surface, said cam member being movable to engage said cam surface in a manner to cause said jaw means to move from said boot retaining position to said boot release position.

19. The assembly as recited in claim 18, wherein said positioning and control means comprises a shaft rotatably mounted in one of said jaw means and base mounting means, and said cam member is mounted to said shaft to be rotatable therewith.

20. The assembly as recited in claim 1, wherein said locking means and comprises a locking arm means moveably mounted to one of said jaw means and said base mounting means and having a locking finger, said assembly further comprising cam means positioned to engage said locking arm means and moveable to move said locking arm means to place said locking finger into locking engagement and out of locking engagement.

21. The assembly as recited in claim 20, wherein said positioning cam in said first locking operating mode holds said locking finger in locking engagement by positive engagement, and in said intermediate step-in mode releasably holds said locking finger in locking engagement, while in said release operating mode, said cam means positively holds said locking finger out of locking engagement.

22. The assembly as recited in claim 21, wherein there is locking arm spring means which releasably urges said locking arm means toward locking engagement.

23. The assembly as recited in claim 22, where said locking arm means has a lengthwise axis and is pivotally mounted for rotation about axis of rotation transverse to said lengthwise axis, and said positioning cam means operates on one end of said arm means, while said locking finger is at an opposite end of said locking arm means.

24. The assembly as recited in claim 1, further comprising a manually operable control handle moveable between three operating positions, namely a first position to place said assembly in the locking operating mode, a second position to place the assembly in the intermediate operating mode, and a third position to place the assembly in the release operating mode.

25. The assembly as recited in claim 1, wherein said base mounting means comprises a base plate adapted to be fixedly connected to said snowboard or the like, and mounting plate adjustably mounted to said base plate for movement to different angular positions.

26. The assembly as recited in claim 16, wherein one of said base plate and said mounting plate have retaining screws mounted in arcuate slots for rotational adjustment, said screws engaging the other of said base plate and mounting plate.

27. The assembly as recited in claim 26, wherein said screws are mounted in said mounting plate and extend downwardly therefrom, with said slots being formed in said base plate, said assembly further comprising retaining nut means mounted in said base plate to engage said screws, whereby said screws can be tightened or loosened from a position above said base plate to tighten or loosen said retaining nuts.

28. The assembly as recited in claim 25, wherein said mounting plate is positioned to extend transversely to a lengthwise axis of a person's boot , said mounting plate comprising forward and rear support extensions to engage, respectively, forefoot and heel portions of a person's boot, with said forward and rear extensions being moveable to different angular locations with said base plate.

29. A binding assembly adapted to hold a person's boot in an operating location on a snowboard or the like and to permit release of said boot, said binding assembly comprising:

a. a base mounting plate means;

b. a jaw means mounted on one side of said plate means to engage one side of said boot;

c. a jaw assembly mounted to an opposite side of said plate means for engaging an opposite side of said boot, said jaw assembly comprising:

i. a jaw housing adapted to engage an opposite side of said boot and mounted to said plate means for movement between a retaining position, in which the jaw housing engages the opposite side of the boot, and a release position;

iii. a locking finger means movably mounted to one of said jaw housing and said plate means for movement into and out of locking engagement with the other of said jaw housing and plate means; and iii. a manually operable position lever operatively engaging said locking finger means so that movement of said lever moves said locking finger means into and out of said locking engagement, thereby permitting said jaw to be moved between said retaining and release positions.

30. The assembly as recited in claim 29, wherein there is spring means operatively engaging said jaw housing to move said jaw housing toward its retaining position.

31. The assembly as recited in claim 30, wherein said positioning lever has three operating positions, namely:

a. a locking position where said locking finger means is held in locking engagement;

b. an intermediate position wherein said locking finger means is out of locking engagement, with said spring means urging said jaw housing to the retaining position;

c. a release position where said lever moves said jaw housing by positive engagement to the release position;

32. The assembly as recited in claim 31, wherein said jaw means and said jaw housing are arranged with surface means operatively engageable with a boot plate so that as the boot plate is moved into a retaining position in said binding assembly, said boot plate interacts with said jaw means and said jaw housing to move said jaw housing away from the retaining position to permit entry of said boot plate into retaining position.

33. The assembly as recited in claim 29, wherein said assembly comprises a rotatable shaft, to which said locking finger is mounted so as to be rotatable therewith.

34. The assembly as recited in claim 33, wherein said assembly further comprises a cam member mounted to said shaft so as to be rotatable therewith said cam member being arranged to engage a related cam surface in a manner to cause the jaw housing to move from said retaining position to said release position.

* * * * *